US011365073B2

(12) United States Patent
Dobashi

(10) Patent No.: US 11,365,073 B2
(45) Date of Patent: Jun. 21, 2022

(54) MANUAL SHEET FEEDING DEVICE AND IMAGE FORMING APPARATUS

(71) Applicant: TOSHIBA TEC KABUSHIKI KAISHA, Tokyo (JP)

(72) Inventor: Shoichi Dobashi, Nagaizumi Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 360 days.

(21) Appl. No.: 16/539,899

(22) Filed: Aug. 13, 2019

(65) Prior Publication Data

US 2020/0270080 A1 Aug. 27, 2020

(30) Foreign Application Priority Data

Feb. 22, 2019 (JP) ..... JP2019-030503

(51) Int. Cl.
*B65H 1/04* (2006.01)
*G03G 15/00* (2006.01)
*B65H 1/12* (2006.01)

(52) U.S. Cl.
CPC ..... *B65H 1/04* (2013.01); *B65H 1/12* (2013.01); *G03G 15/6514* (2013.01); *G03G 15/6529* (2013.01); *B65H 2405/1117* (2013.01); *B65H 2801/03* (2013.01)

(58) Field of Classification Search
CPC ... B65H 1/12; B65H 1/04; B65H 1/08; B65H 2405/1117; B65H 2407/21; G03G 15/6529; G03G 15/6514
See application file for complete search history.

(56) References Cited

U.S. PATENT DOCUMENTS

| | | | | |
|---|---|---|---|---|
| 9,604,806 | B2 * | 3/2017 | Okura | G03G 15/6514 |
| 9,725,260 | B2 * | 8/2017 | Furusawa | B65H 1/04 |
| 10,173,851 | B1 * | 1/2019 | Oshiro | B65H 1/04 |
| 2008/0048384 | A1 | 2/2008 | Kusama | |
| 2016/0122140 | A1 | 5/2016 | Furusawa | |

OTHER PUBLICATIONS

Extended European Search Report issued in European Patent Application No. 19209094.2 dated May 18, 2020 (8 pages).

* cited by examiner

*Primary Examiner* — Jeremy R Severson
(74) *Attorney, Agent, or Firm* — Foley & Lardner LLP

(57) ABSTRACT

According to one embodiment, a manual sheet feeding device includes a pressure plate, a first displacement member, a first input member, a second displacement member, a second input member, a coupling member, a restricting member, and an elastic member. The first displacement member displaces the plate from a first side to a pressure and a release position. The first input member displaces the first displacement member to a first and a second position. The second displacement member displaces the plate from a second side to the pressure and the release position. The second input member displaces the second displacement member to a third and a fourth position. The coupling member gives the second input member a second displacement amount larger than a first displacement amount. The restricting member restricts a displacement amount of the second input member. The elastic member elastically deforms when the amount of displacement is restricted.

20 Claims, 16 Drawing Sheets

MANUAL SHEET FEEDING DEVICE AND IMAGE FORMING APPARATUS

CROSS-REFERENCE TO RELATED APPLICATION

This application is based upon and claims the benefit of priority from Japanese Patent Application No. 2019-030503, filed Feb. 22, 2019, the entire contents of which are incorporated herein by reference.

FIELD

Embodiments described herein relate generally to a manual sheet feeding device and an image forming apparatus.

BACKGROUND

For example, an image forming apparatus includes a manual sheet feeding device. The manual sheet feeding device includes a pressure tray (pressure plate) capable of pressurizing at least a part of a tray receiver on which a sheet is placed upward. Above the pressure tray, for example, a roller such as a sheet feeding roller is disposed.

When setting a sheet on the tray receiver, the pressure tray is disposed at a position pivoted downward. For example, after placing a plurality of sheets on the pressure tray, the user pivots the pressure tray in the opposite direction to put the pressure tray in a pressurized state. An uppermost sheet of the plurality of sheets contacts the roller. As the roller rotates, the uppermost sheet is conveyed.

The manual sheet feeding device includes an operation member for performing an operation of pivoting the pressure tray. The operation member is provided at a position where the operation member can be operated from the front of the image forming apparatus. When the user operates the operation member, the pressure tray is pivoted by an operation transmission mechanism to which the operation member is coupled.

However, various transmission losses occur in the operation transmission mechanism. In particular, in the operation transmission mechanism, when an operation input of the operation member closer to the front is transmitted to the rear of the pressure tray, a transmission loss is likely to occur.

For example, when the pressure tray is pivoted downward by the operation of the operation member, the operation transmission mechanism pivots the pressure tray downward against a biasing force applied to the pressure tray.

In this case, when an amount of rearward displacement in the operation transmission mechanism is reduced due to the transmission loss, a pivot position on the rear side becomes higher than a pivot position on the front side of the pressure tray. In this state, on the rear side of the roller, the roller and the sheet on the pressure tray may come in contact with each other. When the user pulls out the sheet while the rear side of the roller is in contact, uneven wear occurs on the roller. As a result, there is a problem that sheet feeding performance in the manual sheet feeding device deteriorates.

DETAILED DESCRIPTION

Embodiments provide a manual sheet feeding device and an image forming apparatus in which sheet feeding performance does not easily deteriorate.

In general, according to one embodiment, a manual sheet feeding device includes a manual feed tray, a sheet feeding unit, a pressure plate, a first displacement member, a first input member, a second displacement member, a second input member, a coupling member, a restricting member, and an elastic member. The manual feed tray places a sheet thereon. The sheet feeding unit feeds the sheet placed on the manual feed tray in a conveyance direction. The pressure plate pressurizes the sheet toward the sheet feeding unit at a pressure position. The first displacement member is provided on a first side portion in a conveyance orthogonal direction orthogonal to the conveyance direction in a plane parallel to a placement surface of the manual feed tray. The first displacement member displaces the pressure plate from the first side portion to the pressure position and a pressure release position by being displaced to a first position and a second position. The first input member is disposed on the first side portion and displaces the first displacement member to the first position and the second position by being displaced by a predetermined amount. The second displacement member is provided on a second side portion on a side opposite to the first side portion in the conveyance orthogonal direction. The second displacement member displaces the pressure plate from the second side portion to the pressure position and the pressure release position by being displaced to a third position and a fourth position. The second input member is disposed on the second side portion, and displaces the second displacement member to the third position and the fourth position by being displaced by a predetermined amount. The coupling member gives the second input member a second displacement amount larger than a first displacement amount by which the first input member is displaced. The restricting member restricts a displacement amount of the second input member. The elastic member is provided on the coupling member. The elastic member elastically deforms when the amount of displacement of the second input member is restricted by the restricting member.

Hereinafter, a manual sheet feeding device and an image forming apparatus according to the embodiment will be described with reference to the drawings.

Figure 1:
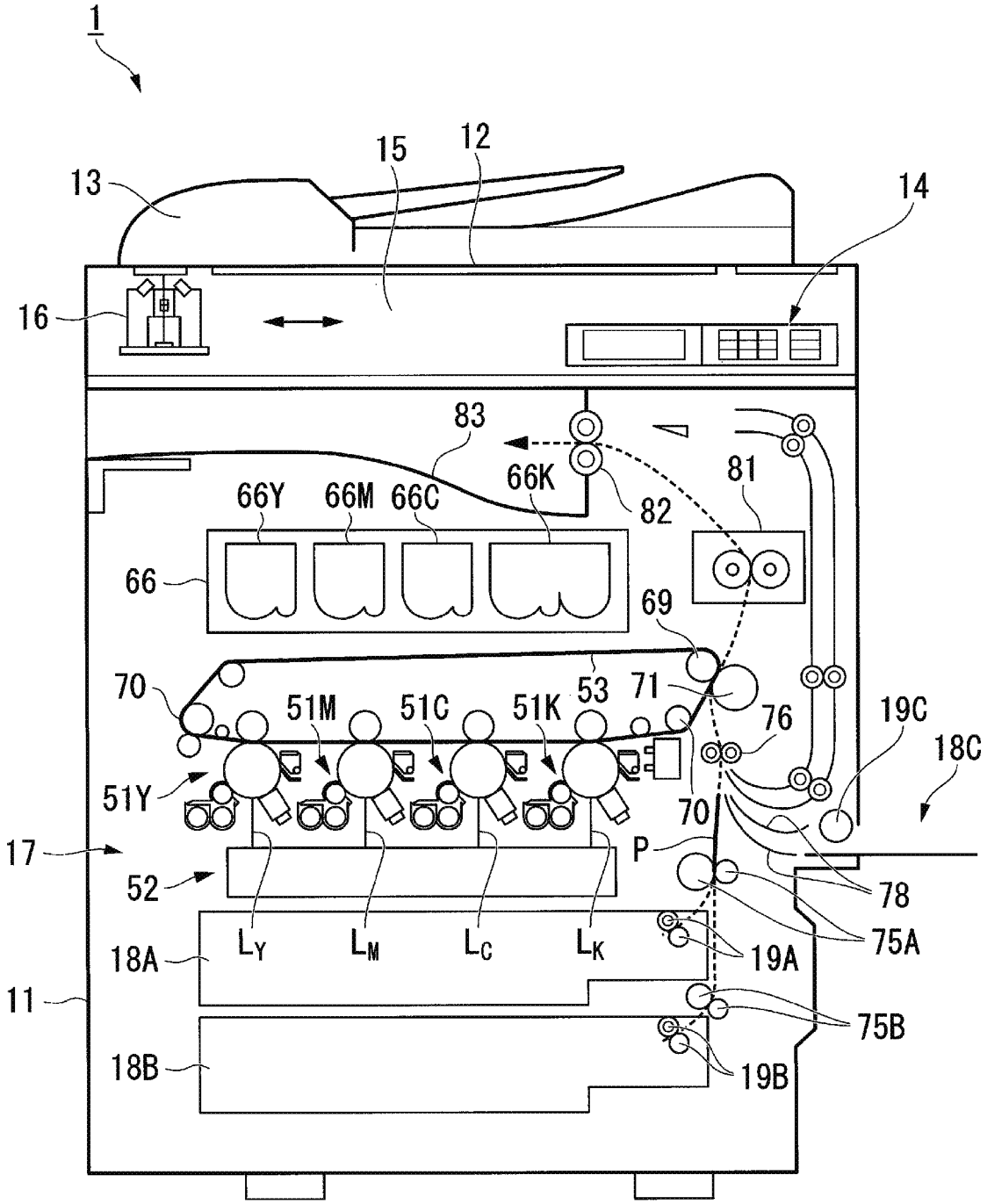
FIG. 1 is a schematic cross-sectional view illustrating a configuration example of an image forming apparatus according to an embodiment.
Figure 2:
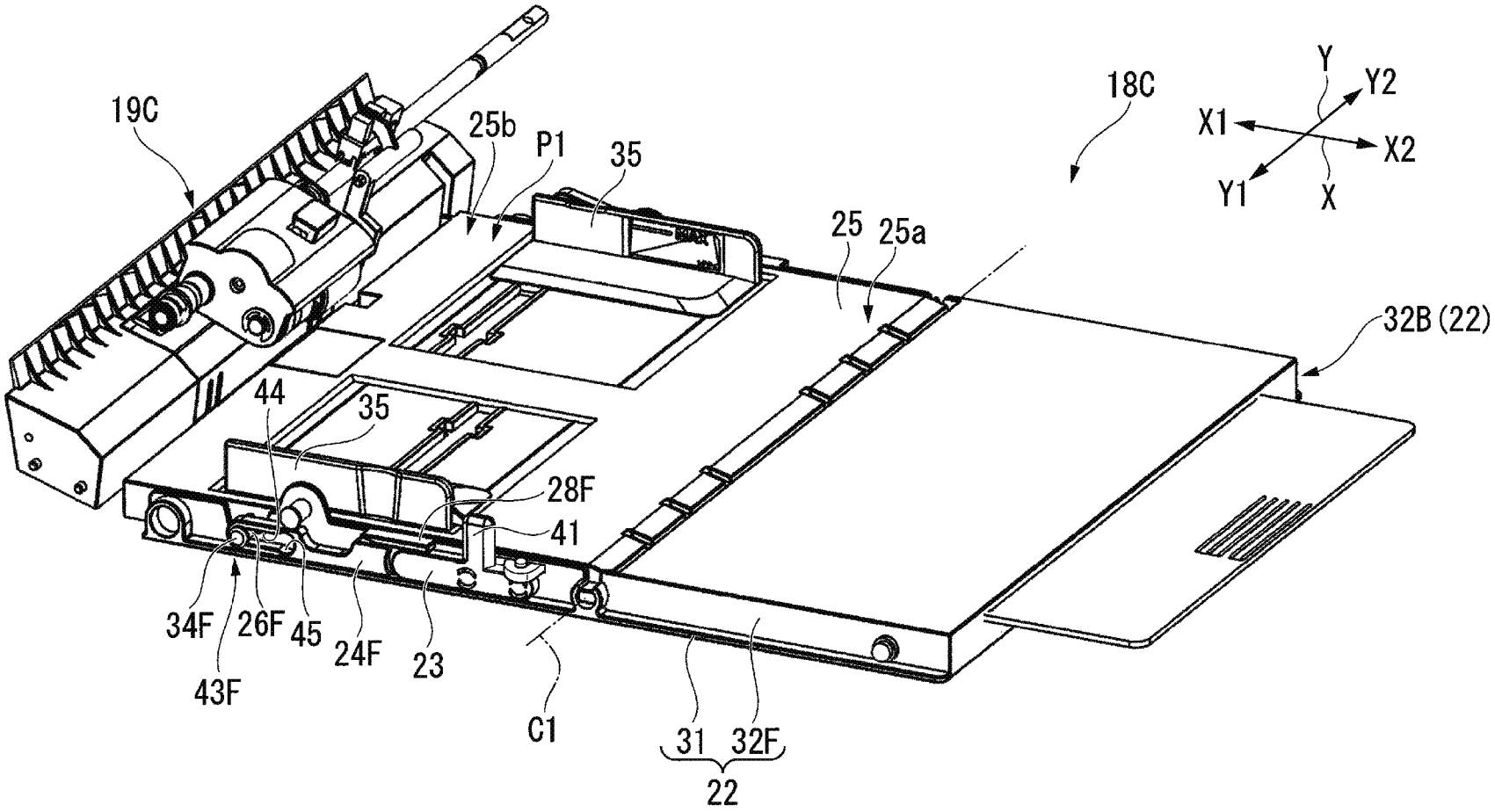
FIG. 2 is a schematic perspective view illustrating a configuration example of a manual sheet feeding device.
Figure 3:
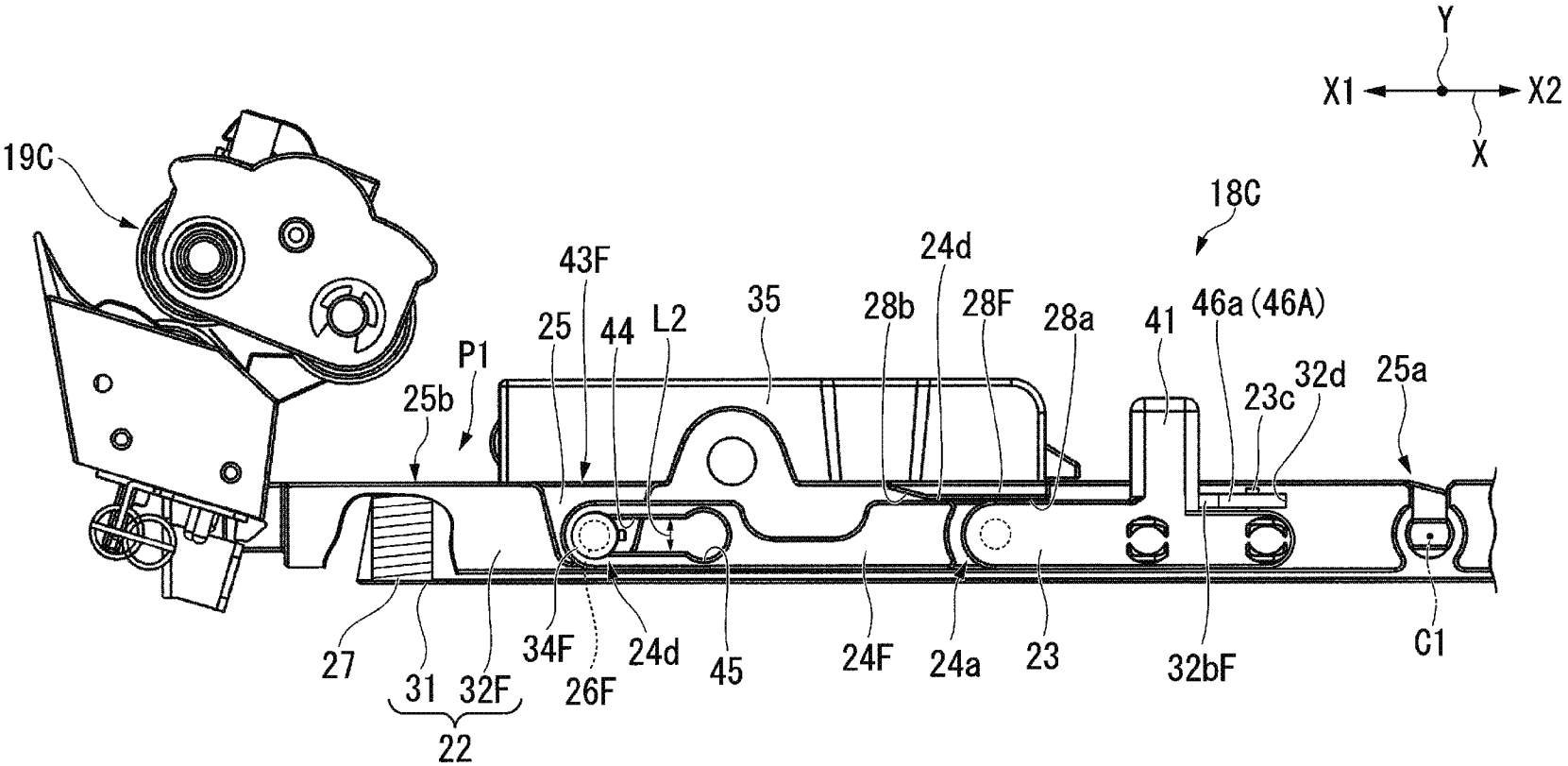
FIG. 3 is a schematic front view illustrating a configuration example of the manual sheet feeding device.
Figure 4:
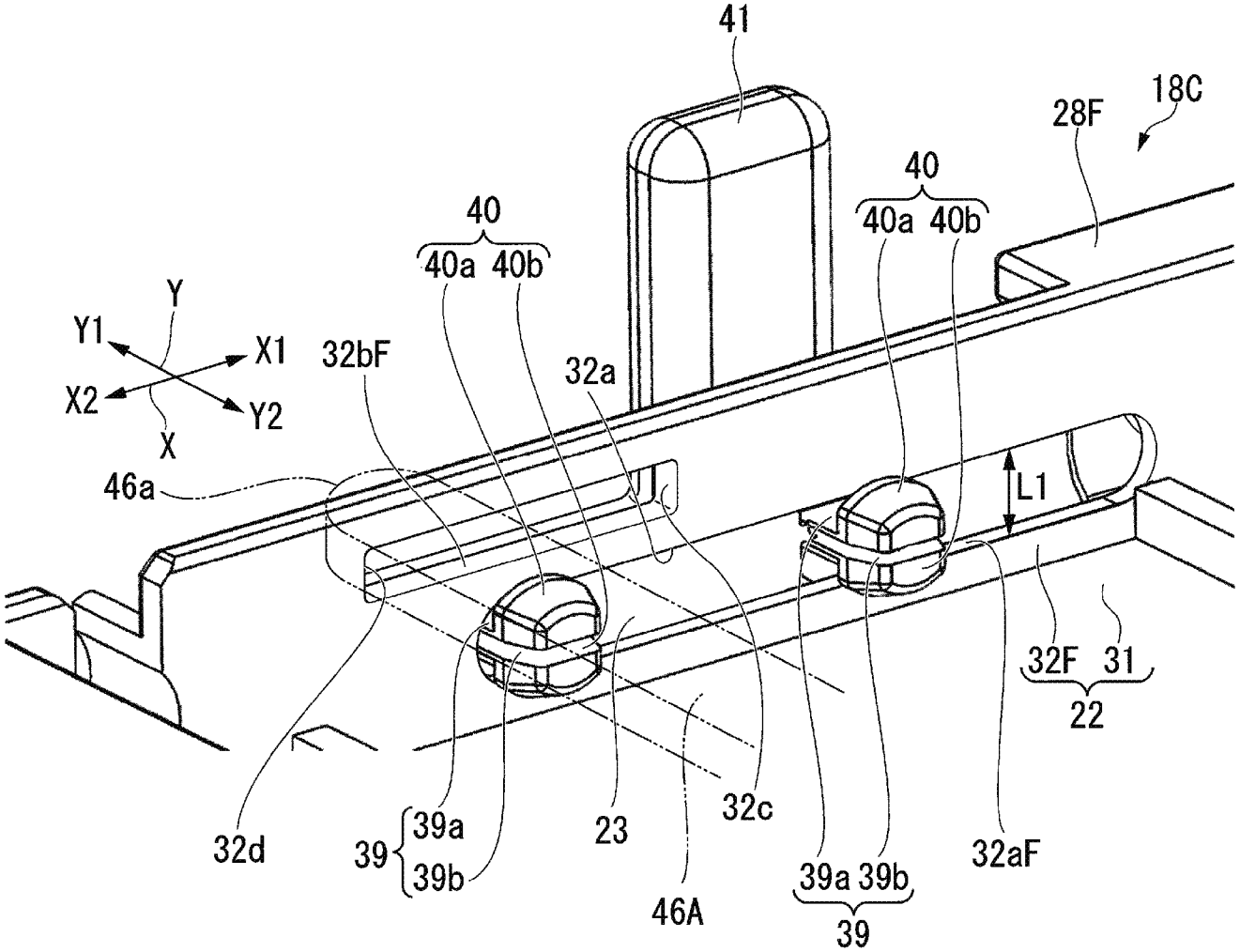
FIG. 4 is a schematic perspective view illustrating a main part of a first input member and a first side portion in the manual sheet feeding device.
Figure 5:
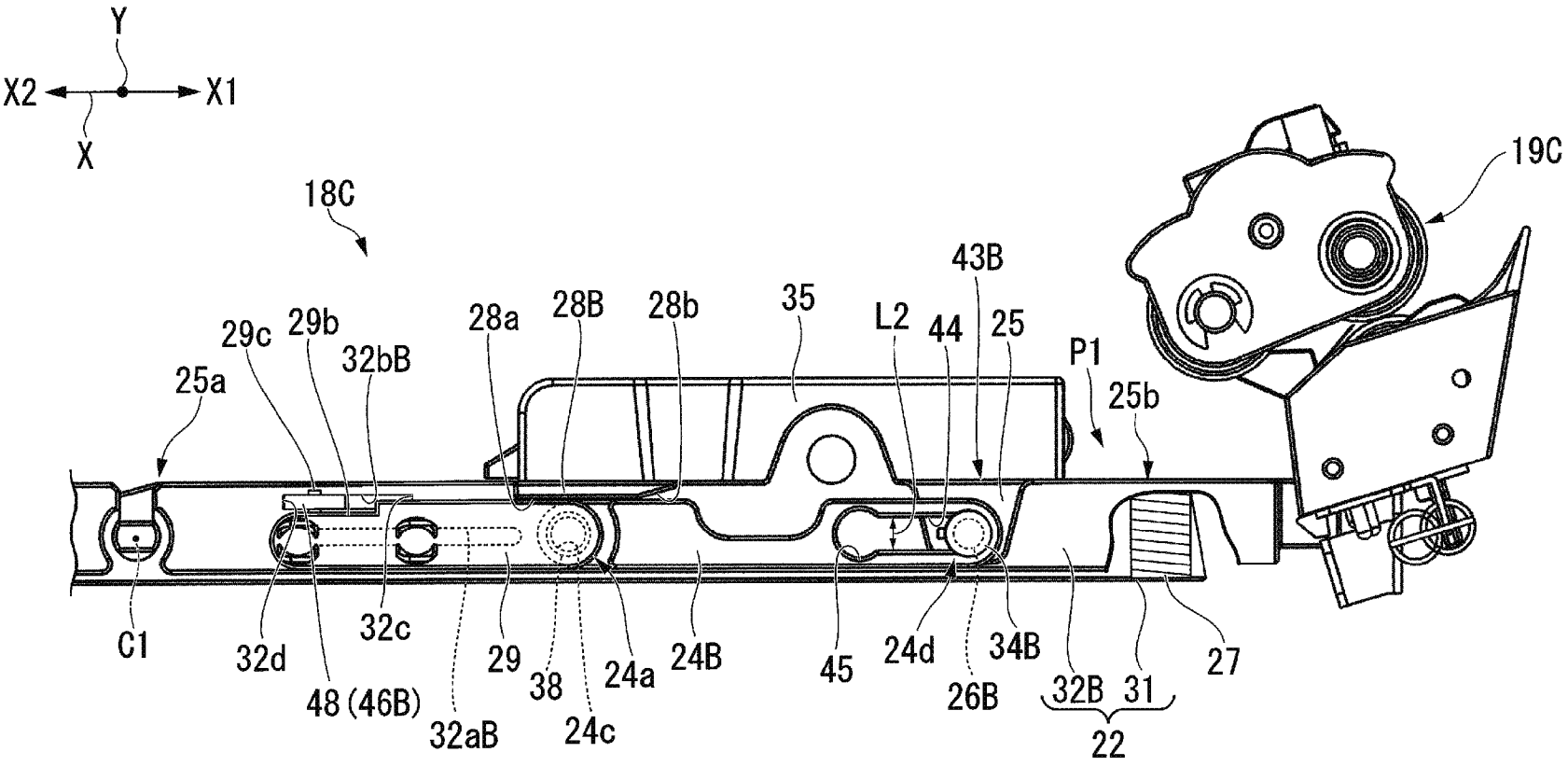
FIG. 5 is a schematic rear view illustrating a configuration example of the manual sheet feeding device.
Figure 6:
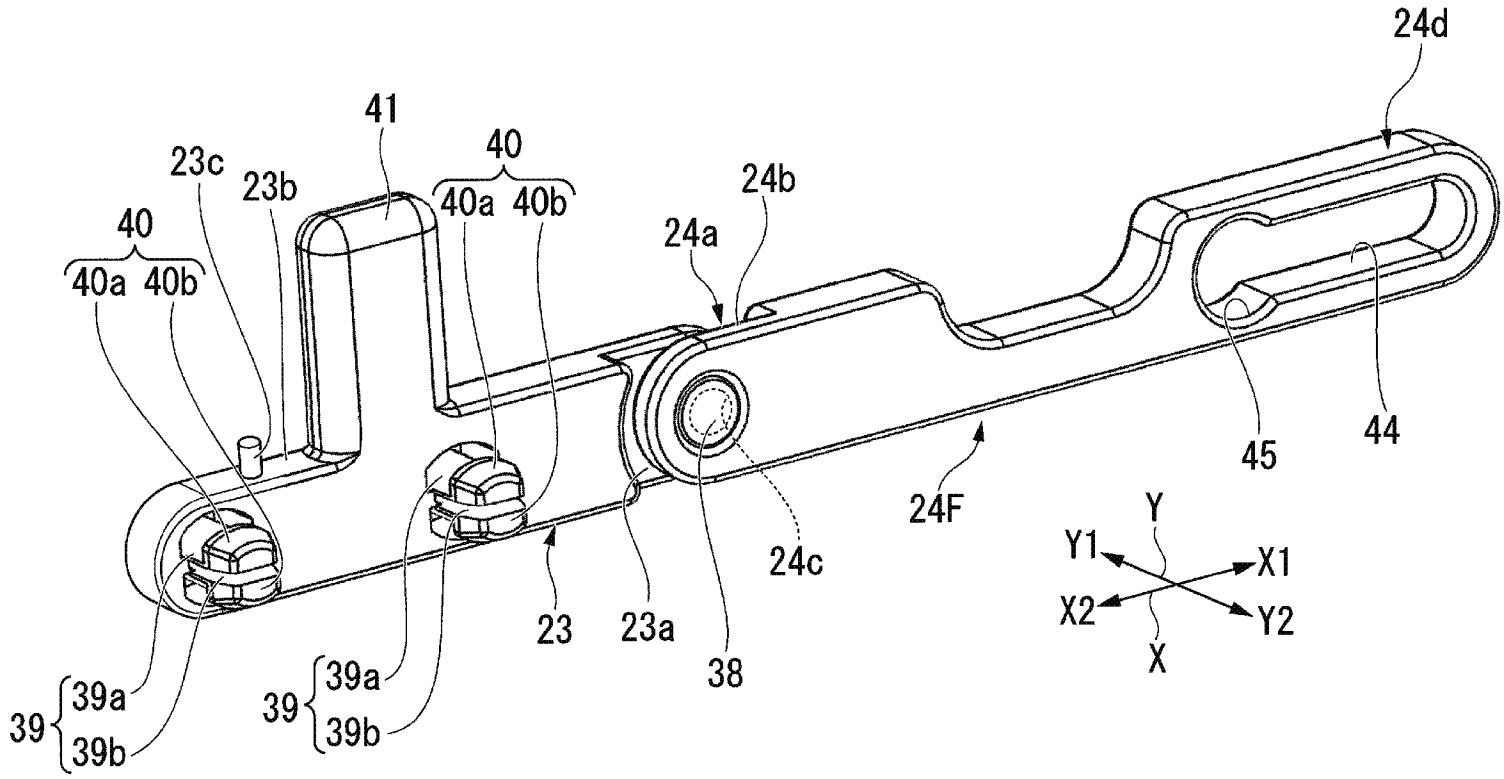
FIG. 6 is a schematic perspective view illustrating a configuration example of the first input member and a first displacement member.
Figure 7:
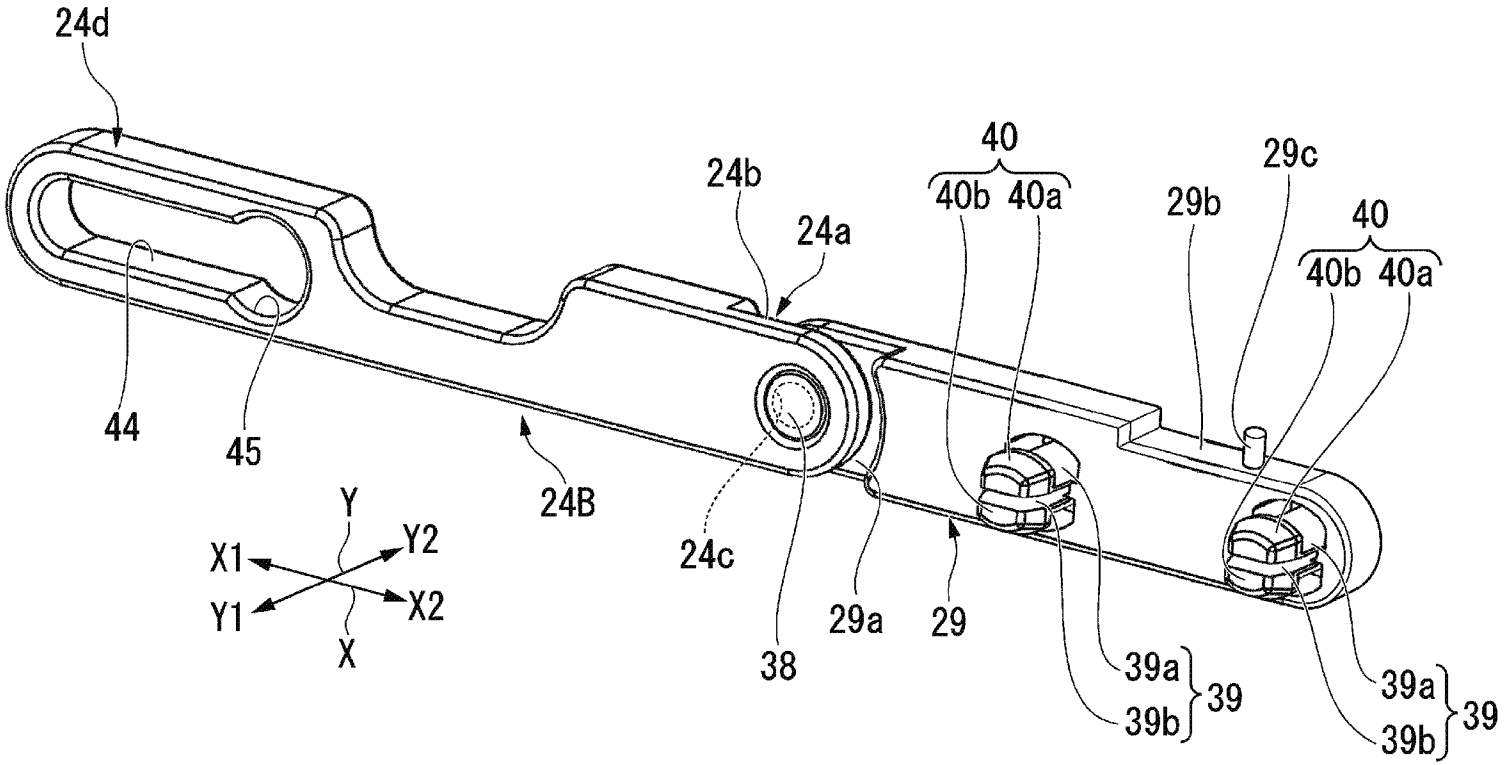
FIG. 7 is a schematic perspective view illustrating a configuration example of a second input member and a second displacement member.

FIG. 1 is a schematic cross-sectional view illustrating a configuration example of an image forming apparatus according to an embodiment. FIGS. 2 and 3 are a schematic perspective view and a schematic front view illustrating a configuration example of a manual sheet feeding device according to the embodiment, respectively. FIG. 4 is a schematic perspective view illustrating a main part of a first input member and a first side portion in the manual sheet feeding device according to the embodiment. FIG. 5 is a schematic rear view illustrating a configuration example of the manual sheet feeding device according to the embodiment. FIG. 6 is a schematic perspective view illustrating a configuration example of the first input member and a first displacement member in the manual sheet feeding device according to the embodiment. FIG. 7 is a schematic perspective view illustrating a configuration example of a second input member and a second displacement member in the manual sheet feeding device according to the embodiment.

An image forming apparatus 1 according to the embodiment illustrated in FIG. 1 is, for example, a multi-function peripheral (MFP) which is a composite machine, a printer, a copying machine, and the like.

The image forming apparatus 1 includes a main body 11. A scanner unit 15 and an automatic document feeder (ADF) 13 are provided on the upper portion of the main body 11. An operation unit 14 is provided on the upper portion of the main body 11.

The scanner unit 15 includes an image sensor 16 such as a contact image sensor. The image sensor 16 reads an image of an original document placed on a document table 12 or an image of the original document sent by the ADF 13. The scanner unit 15 generates image data of an original document from the output of the image sensor 16.

The main body 11 includes a transfer unit 17 at the center in the height direction. The main body 11 includes sheet feeding cassettes 18A and 18B and a manual sheet feeding unit 18C (manual sheet feeding device) of the embodiment at the lower portion.

The manual sheet feeding unit 18C protrudes to a side of the main body 11.

The sheet feeding cassettes 18A and 18B and the manual sheet feeding unit 18C accommodate sheets P of various sizes.

The sheet feeding cassette 18A (18B) includes a sheet feeding mechanism 19A (19B). The phrase "the sheet feeding cassette 18A (18B) includes a sheet feeding mechanism 19A (19B)" means that the sheet feeding cassette 18A includes the sheet feeding mechanism 19A and the sheet feeding cassette 18B includes the sheet feeding mechanism 19B. In the following description, when it is clear that symbols (or terms) in parentheses similarly correspond to the symbols (or terms) before the parentheses, similar notation may be made for simplification.

The sheet feeding mechanism 19A (19B) takes out sheets P one by one from the sheet feeding cassette 18A (18B) and sends the sheet P to a conveyance path of the sheet P.

As illustrated in FIGS. 2 and 3, the manual sheet feeding unit 18C includes a manual sheet feeding mechanism 19C (sheet feeding unit). The manual sheet feeding mechanism 19C may include, for example, a pickup roller, a separation roller, and a paper feed roller. The manual sheet feeding mechanism 19C takes out the sheets P one by one from the manual sheet feeding unit 18C and sends the sheet P to the conveyance path.

Furthermore, the manual sheet feeding unit 18C includes a tray receiver 22 (manual sheet tray), a spring 27 (see FIG. 3), a pressure tray 25 (pressure plate, manual sheet tray), a lever 23 (first input member), a link 24F (first displacement member), a link 29 (second input member), and a link 24B (second displacement member).

In FIGS. 2 to 8, a state in which a second end portion 25*b* described later of the pressure tray 25 is moved to a pressure release position P1 (see FIG. 3) approaching the tray receiver 22 is illustrated. When there is no risk of misunderstanding, for the sake of simplicity, a fact that the second end portion 25*b* of the pressure tray 25 described later is positioned at the pressure release position P1 may be described as an expression of "the pressure tray 25 is positioned at the pressure release position P1".

The tray receiver 22 includes a bottom plate 31, a first side wall 32F (first side portion) and a second side wall 32B (restricting member (second side portion), see FIG. 5).

For example, the bottom plate 31 is a rectangular plate having an outer edge extending in the conveyance direction X of the sheet P and an outer edge extending in the conveyance orthogonal direction Y orthogonal to the conveyance direction X, respectively. When the manual sheet feeding unit 18C is used, the bottom plate 31 is disposed substantially along the horizontal surface.

In the following, unless otherwise specified, the positional relationship of each part will be described based on the arrangement at the time of use of the manual sheet feeding unit 18C.

In the conveyance direction X, a direction from the upstream side to the downstream side of conveyance is referred to as a first direction X1, and a direction from the downstream side to the upstream side of the conveyance is referred to as a second direction X2. When viewed in the first direction X1, in the conveyance orthogonal direction Y, a direction from right to left is referred to as a first direction Y1 and a direction from left to right is referred to as a second direction Y2. The first direction Y1 (second direction Y2) is a direction from the rear to the front (from the front to the rear) of the image forming apparatus 1.

As illustrated in FIG. 3, a lower end portion of the spring 27 described above is fixed to the top surface of the bottom plate 31 in the first direction X1. The spring 27 expands and contracts in the vertical direction. For example, a helical spring or the like is used as the spring 27. It is more preferable that a plurality of the springs 27 is fixed to the bottom plate 31 at intervals in the conveyance orthogonal direction Y.

As illustrated in FIG. 2, the first side wall 32F is formed in a plate shape. The first side wall 32F is disposed at the outer edge of the bottom plate 31 in the first direction Y1.

As illustrated in FIG. 4, a tray side long hole 32*a*F extending in the conveyance direction X is formed in the first side wall 32F. The tray side long hole 32*a*F penetrates the first side wall 32F in the conveyance orthogonal direction Y. In the first side wall 32F, a fixing portion 28F is provided above the end portion of the tray side long hole 32*a*F in the first direction X1.

The fixing portion 28F is a plate-like portion protruding in the first direction Y1 from the upper end portion of the first side wall 32F. The fixing portion 28F extends in the first direction X1 from above the end portion of the tray side long hole 32*a*F in the first direction X1. As illustrated in FIG. 3, the front and back surface of the fixed portion 28F faces the vertical direction. Below the fixed portion 28F, a link 24F described later is disposed.

A guide surface 28*b* is formed at an end portion of the lower surface of the fixed portion 28F in the first direction X1. The guide surface 28*b* is a flat surface that gradually inclines upward as the guide surface 28*b* proceeds in the first direction X1. When the link 24F enters downward, the guide surface 28*b* restricts an inclined posture of the link 24F from above.

On the lower surface of the fixed portion 28F, a holding surface 28*a* excluding the guide surface 28*b* is a flat surface extending in the conveyance direction X. The holding surface 28*a* can abut on the link 24F from above. When the link 24F enters under the holding surface 28*a*, the posture of the link 24F can be maintained such that the longitudinal direction of the link 24F is the conveyance direction X.

As illustrated in FIG. 4, in the first side wall 32F, a link insertion long hole 32*b*F penetrates in the conveyance orthogonal direction Y above the end portion of the tray side long hole 32*a*F in the second direction X2. The link insertion long hole 32*b*F is a rectangular hole elongated in the conveyance direction X. A first end surface 32*c* which is an end surface in the first direction X1 and a second end surface 32*d* which is an end surface in the second direction X2 are formed on the inner surface of the link insertion long hole 32*b*F.

As illustrated in FIG. 2, the second side wall 32B is formed in a plate shape, similar to the first side wall 32F. The second side wall 32B is disposed at the outer edge of the bottom plate 31 in the second direction Y2.

As illustrated in FIG. 5, a tray side long hole 32*a*B and a link insertion long hole 32*b*B are formed in the second side wall 32B.

The tray side long hole 32*a*B and the link insertion long hole 32*b*B have the same shape as the tray side long hole 32*a*F and the link insertion long hole 32*b*F of the first side wall 32F, respectively.

The tray side long hole 32*a*B and the link insertion long hole 32*b*B are formed at positions facing the tray side long hole 32*a*F and the link insertion long hole 32*b*F in the first side wall 32F in the conveyance orthogonal direction Y. The tray side long hole 32*a*B and the link insertion long hole 32*b*B penetrate the second side wall 32B in the conveyance orthogonal direction Y.

A first end surface 32*c* and a second end surface 32*d* are formed on the inner surface of the link insertion long hole 32*b*B, similarly to the link insertion long hole 32*b*F.

In the second side wall 32B, a fixing portion 28B is provided above the end portion of the tray side long hole 32*a*B in the first direction X1.

The fixing portion 28B is formed in a plane-symmetrical shape with the fixing portion 28F with respect to a plane orthogonal to the conveyance orthogonal direction Y.

The fixing portion 28B is a plate-like portion protruding from the upper end portion of the second side wall 32B in the second direction Y2 (forward in the paper surface of FIG. 5). The fixing portion 28B extends in the first direction X1 from above the end portion of the tray side long hole 32*a*B in the first direction X1. Below the fixed portion 28B, a link 24B described later is disposed.

At the end portion of the lower surface of the fixed portion 28B in the first direction X1, the guide surface 28*b* is formed, similarly to the fixed portion 28F. On the lower surface of the fixed portion 28B, a holding surface 28*a* is formed at a portion excluding the guide surface 28*b*, similarly to the fixed portion 28F. When the link 24B enters downward, the guide surface 28*b* of the fixed portion 28B restricts the inclined posture of the link 24B from above. The holding surface 28*a* of the fixing portion 28B can abut on the link 24B from above. When the link 24B enters under the holding surface 28*a*, the posture of the link 24B can be maintained such that the longitudinal direction of the link 24B is the conveyance direction X.

As illustrated in FIG. 2, the pressure tray 25 is formed in a plate shape. The pressure tray 25 moved to the pressure release position P1 is disposed substantially along the horizontal surface. A boss or the like (not illustrated) is formed at a first end portion 25*a* which is an end portion in the pressure tray 25 in the second direction X2. The boss is engaged with a boss receiver (not illustrated) or the like formed on the tray receiver 22. With this configuration, the first end portion 25*a* of the pressure tray 25 is supported pivotably about an axis C1. The axis C1 is an axis parallel to the conveyance orthogonal direction Y.

The boss receiver of the tray receiver 22 is disposed at a portion away from any of the tray side long holes 32*a*F and 32*a*B, the fixing portions 28F and 28B, and the springs 27 in the second direction X2.

At the second end portion 25*b* which is an end portion in the first direction X1 in the pressure tray 25, a tray side protrusion 26F (see FIGS. 2 and 3) and a tray side protrusion 26B (see FIG. 5) are provided. The tray side protrusion 26F protrudes in the first direction Y1 from the side portion of the pressure tray 25 located furthest in the first direction Y1. The tray side protrusion 26B protrudes in the second direction Y2 from the side portion of the pressure tray 25 located furthest in the second direction Y2.

For example, the tray side protrusions 26F and 26B are formed in a cylindrical shape. The tray side protrusions 26F and 26B have a central axis coaxial with the same axis parallel to the conveyance orthogonal direction Y.

The tray side protrusions 26F and 26B are disposed closer to the second end portion 25*b* than the first end portion 25*a* of the pressure tray 25.

A tray side engaging portion 34F (34B) is formed at the tip end portion of the tray side protrusion 26F (26B) in the conveyance orthogonal direction Y. For example, the tray side engaging portion 34F (34B) is formed in a disk shape. The tray side engaging portion 34F (34B) is disposed coaxially with the tray side protrusion 26F (26B). The outer diameter of the tray side engaging portion 34F (34B) is larger than the outer diameter of the tray side protrusion 26F (26B).

A pair of horizontal registration plates 35 is attached to the pressure tray 25. Each horizontal registration plate 35 is movable in the conveyance orthogonal direction Y with respect to the pressure tray 25. The pressure tray 25 supports the sheet P on the top surface. The sheet P is sandwiched between the pair of horizontal registration plates 35.

The upper end portion of the spring 27 described above is fixed to the lower surface of the second end portion 25*b* of the pressure tray 25. The spring 27 biases the second end portion 25*b* of the pressure tray 25 upward such that the pressure tray 25 separates from the tray receiver 22.

As illustrated in FIG. 6, the lever 23 is formed in a plate shape extending in the conveyance direction X. Each surface in a plate thickness direction of the lever 23 faces the conveyance orthogonal direction Y.

A step 23*a* is formed on the surface of the end portion of the lever 23 in the first direction X1 in the second direction Y2. The step 23*a* is recessed in the first direction Y1. A shaft member 38 is provided on the bottom surface of the step 23*a*. The shaft member 38 extends in the second direction Y2. The tip end portion of the shaft member 38 is expanded in diameter. The shaft member 38 pivotably couples the link 24F described later around the central axis of the shaft member 38.

At the end portion of the lever 23 in the second direction X2, two protrusions 39 are disposed separately in the conveyance direction X. However, the number of protrusions 39 may be three or more.

The protrusion 39 includes an upper protruding piece 39*a* disposed upward and a lower protruding piece 39*b* disposed downward. The upper protruding piece 39*a* and the lower protruding piece 39*b* are disposed to be spaced apart from each other in the vertical direction. When viewed in the conveyance orthogonal direction Y, the upper protruding piece 39*a* and the lower protruding piece 39*b* are semicircular shapes that protrude upward and downward, respectively. The outer shape of the protrusion 39 as a whole is cylindrical. The outer diameter (length in the vertical direction) of the protrusion 39 is shorter than a short diameter L1 (inner diameter in the vertical direction, see FIG. 4) of the tray side long hole 32*a*F. Each protrusion 39 is inserted into the tray side long hole 32*a*F. Each protrusion 39 is movable in the conveyance direction X in the tray side long hole 32*a*F. The levers 23 are movable in the conveyance direction X with respect to the tray receiver 22 by the respective projections 39 and the tray side long holes 32*a*F.

An engaging portion 40 is formed at an end portion of each protrusion 39 in the second direction Y2. The engaging portion 40 includes an upper engaging piece 40*a* formed on the upper protruding piece 39*a* and a lower engaging piece 40*b* formed on the lower protruding piece 39*b*. The upper engagement piece 40*a* protrudes above the upper protruding piece 39*a*. The lower engagement piece 40*b* protrudes below the lower protruding piece 39*b*. As illustrated in FIG. 4, each engaging portion 40 is locked to the surface in the second direction Y2 of the first side wall 32F. The first side wall 32F is sandwiched by the lever 23 and the engaging portion 40 in the conveyance orthogonal direction Y.

As illustrated in FIG. 6, a knob 41 is formed on the top surface of the lever 23. The knob 41 protrudes upward from the lever 23. For example, the knob 41 is disposed at a substantially central portion in the longitudinal direction (conveyance direction X) of the lever 23.

In the lever 23, an engagement shaft 23*c* is provided on a top surface 23*b* on the second direction X2 side of the knob 41. The outer shape of the engagement shaft 23*c* is a cylindrical shape extending upward from the top surface 23*b*.

The link 24F is formed in a plate shape extending in the conveyance direction X. Each surface in the plate thickness direction of the link 24F faces the conveyance orthogonal direction Y. The plate thickness of the link 24F is equal to the plate thickness of the lever 23.

A step 24*b* is formed on the surface in the first end portion 24*a* of the link 24F in the first direction Y1. The first end portion 24*a* is an end portion of the link 24F in the second direction X2.

The step 24*b* is recessed in the second direction Y2. An engagement hole 24*c* penetrates through the step 24*b*. The engagement hole 24*c* pivotably fits the shaft member 38.

The step 24*b* of the link 24F and the step 23*a* of the lever 23 are engaged with each other in the conveyance orthogonal direction Y. In the engaged state of the step portions 24*b* and 23*a*, the shaft member 38 of the lever 23 is inserted into the engagement hole 24*c* of the link 24F. The link 24F is pivotable about the shaft member 38. The tip end portion of the shaft member 38 is locked at an opening peripheral edge of the engagement hole 24*c* in the first direction Y1.

A link side long hole 44 extending in the conveyance direction X is formed at the second end portion 24*d* opposite to the first end portion 24*a* in the link 24F. The link side long hole 44 penetrates in the thickness direction of the link 24F.

As illustrated in FIG. 3, the link side long hole 44, the tray side protrusion 26F, and the engagement mechanism 43F are configured according to an embodiment. The short diameter L2 (inner diameter in the vertical direction) of the link side long hole 44 is larger than the outer diameter of the tray side protrusion 26F. The short diameter L2 is smaller than the outer diameter of the tray side engaging portion 34F. The link 24F is sandwiched by the tray side engaging portion 34F and the pressure tray 25 in the conveyance orthogonal direction Y.

A circular large-diameter hole 45 is formed at the end portion of the link side long hole 44 in the second direction X2. The large-diameter hole 45 penetrates in the plate thickness direction of the link 24F. The inner diameter of the large-diameter hole 45 is larger than the short diameter L2 of the link side long hole 44 and the outer diameter of the tray side engaging portion 34F.

The link side long hole 44 and the large-diameter hole 45 communicate with each other.

The tray side protrusion 26F is inserted into the link side long hole 44 of the link 24F. The tray side protrusion 26F is movable in the longitudinal direction of the link side long hole 44 with respect to the link side long hole 44.

The tray side engaging portion 34F cannot be inserted into the link side long hole 44 and can be inserted into the large-diameter hole 45.

As illustrated in FIG. 7, the link 29 has a shape that is plane-symmetrical to the lever 23 with respect to a plane orthogonal to the conveyance orthogonal direction Y, except that the knob 41 is removed.

A step 29*a* corresponding to the step 23*a* is formed on the surface of the end portion in the first direction X1 of the link 29 in the first direction Y1. The same shaft member 38 as that of the lever 23 is provided on the bottom surface of the step 29*a*. However, the shaft member 38 in the link 29 extends in the first direction Y1. The shaft member 38 in the link 29 pivotably couples a link 24B described later around a central axis of the shaft member 38.

The link 29 includes a protrusion 39 and an engaging portion 40 similar to those of the lever 23.

Each protrusion 39 in the link 29 protrudes from the surface of the link 29 in the first direction Y1 in the first direction Y1. Each protrusion 39 in the link 29 is inserted into the tray side long hole 32*a*B.

The link 29 is movable in the conveyance direction X with respect to the tray receiver 22 by each protrusion 39 and the tray side long hole 32*a*B.

Each engaging portion 40 in the link 29 is locked to the surface of the second side wall 32B in the first direction Y1. The second side wall 32B is sandwiched by the link 29 and each engaging portion 40 of the link 29 in the conveyance orthogonal direction Y.

The top surface of the link 29 is a flat surface as a whole. However, at the end portion of the link 29 in the second direction X2, a top surface 29*b* and an engagement shaft 29*c* (second input portion) similar to the top surface 23*b* of the lever 23 and the engagement shaft 23*c* are provided. A position of the engagement shaft 29*c* disposed on the link 29 in the conveyance direction X is the same as a position of the engagement shaft 23*c* disposed on the lever 23.

The link 24B has a shape that is plane-symmetrical to the link 24F with respect to a plane orthogonal to the conveyance orthogonal direction Y. The link 24B includes a step 24*b*, a link side long hole 44, and a large-diameter hole 45, similarly to the link 24F.

However, the step 24*b* of the link 24B is recessed in the first direction Y1.

Similarly to the link 24F, an engagement hole 24*c* penetrates through the step 24*b* of the link 24B. However, the engagement hole 24*c* in the link 24B pivotably fits the shaft member 38 in the link 29.

The step 24*b* of the link 24B and the step 29*a* of the link 29 are engaged with each other in the conveyance orthogonal direction Y. In the engaged state of the step portions 24*b* and 29*a*, the shaft member 38 of the link 29 is inserted into the engagement hole 24*c* of the link 24B. The link 24B is pivotable about the central axis of the shaft member 38 in the link 29. The tip end portion of the shaft member 38 described in the link 29 is locked at the opening peripheral edge of the engagement hole 24*c* in the link 24B in the second direction Y2.

As illustrated in FIG. 5, the link side long hole 44 in the link 24B and the tray side protrusion 26B constitute an engagement mechanism 43B. The link 24B is sandwiched by the tray side engaging portion 34B and the pressure tray 25 in the conveyance orthogonal direction Y.

The tray side protrusion 26B is inserted into the link side long hole 44 in the link 24B. The tray side protrusion 26B is movable in the longitudinal direction of the link side long hole 44 with respect to the link side long hole 44 in the link 24B.

The tray side engaging portion 34B cannot be inserted into the link side long hole 44 and can be inserted into the large-diameter hole 45.

Next, a coupling member in the manual sheet feeding unit 18C will be described.

Figure 8:
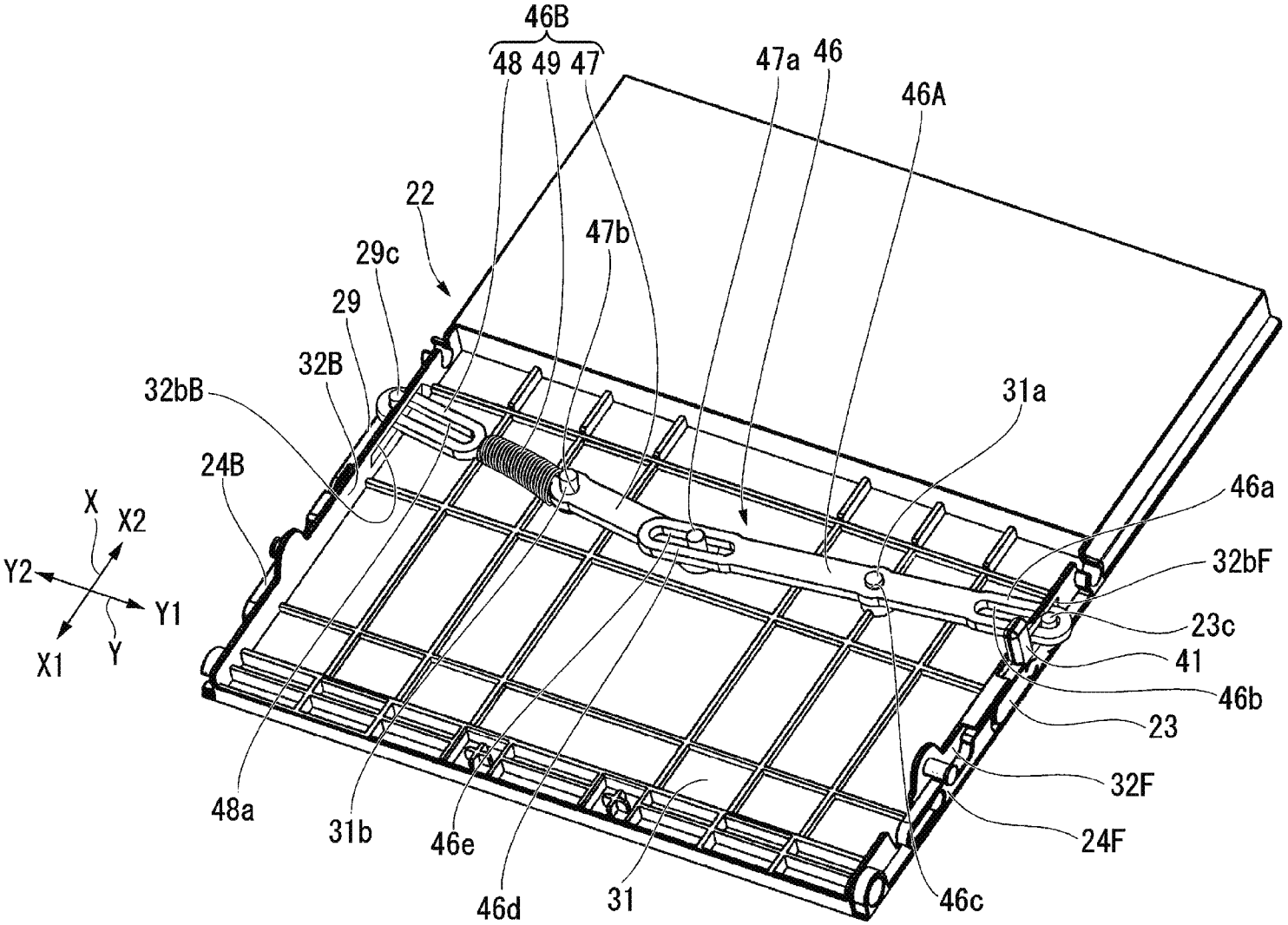
FIG. 8 is a schematic perspective view illustrating a configuration example of a coupling member.
Figure 9:
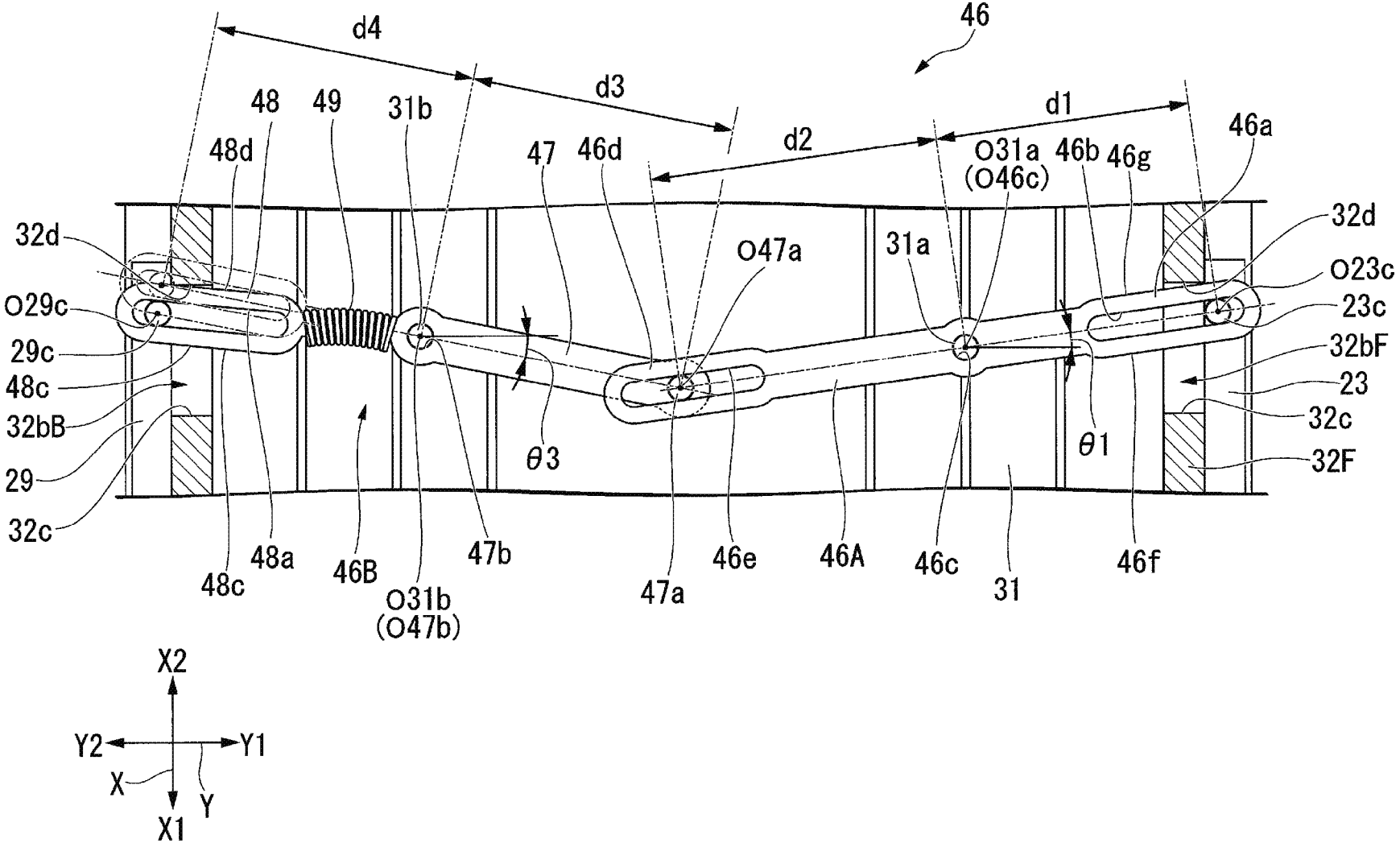
FIG. 9 is a schematic plan view illustrating the coupling member (first pivot state and third pivot state)
Figure 10:
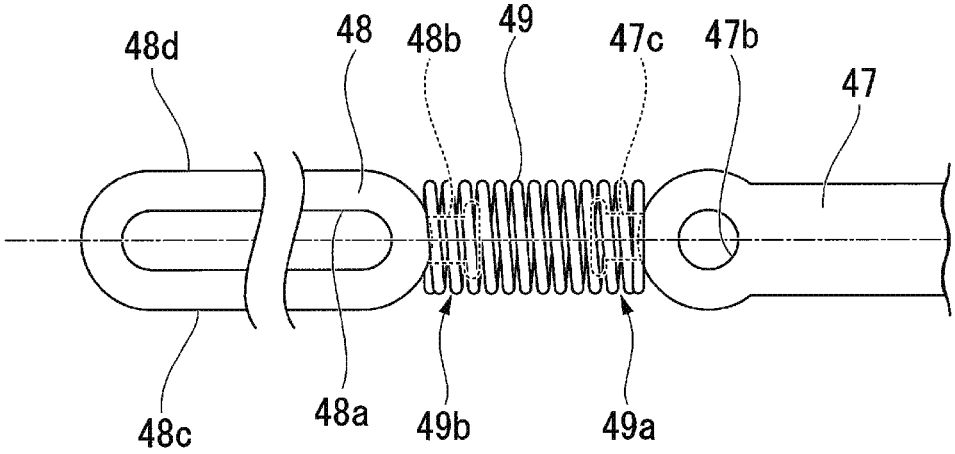
FIG. 10 is a schematic plan view illustrating a configuration example of an elastic member.
Figure 11:
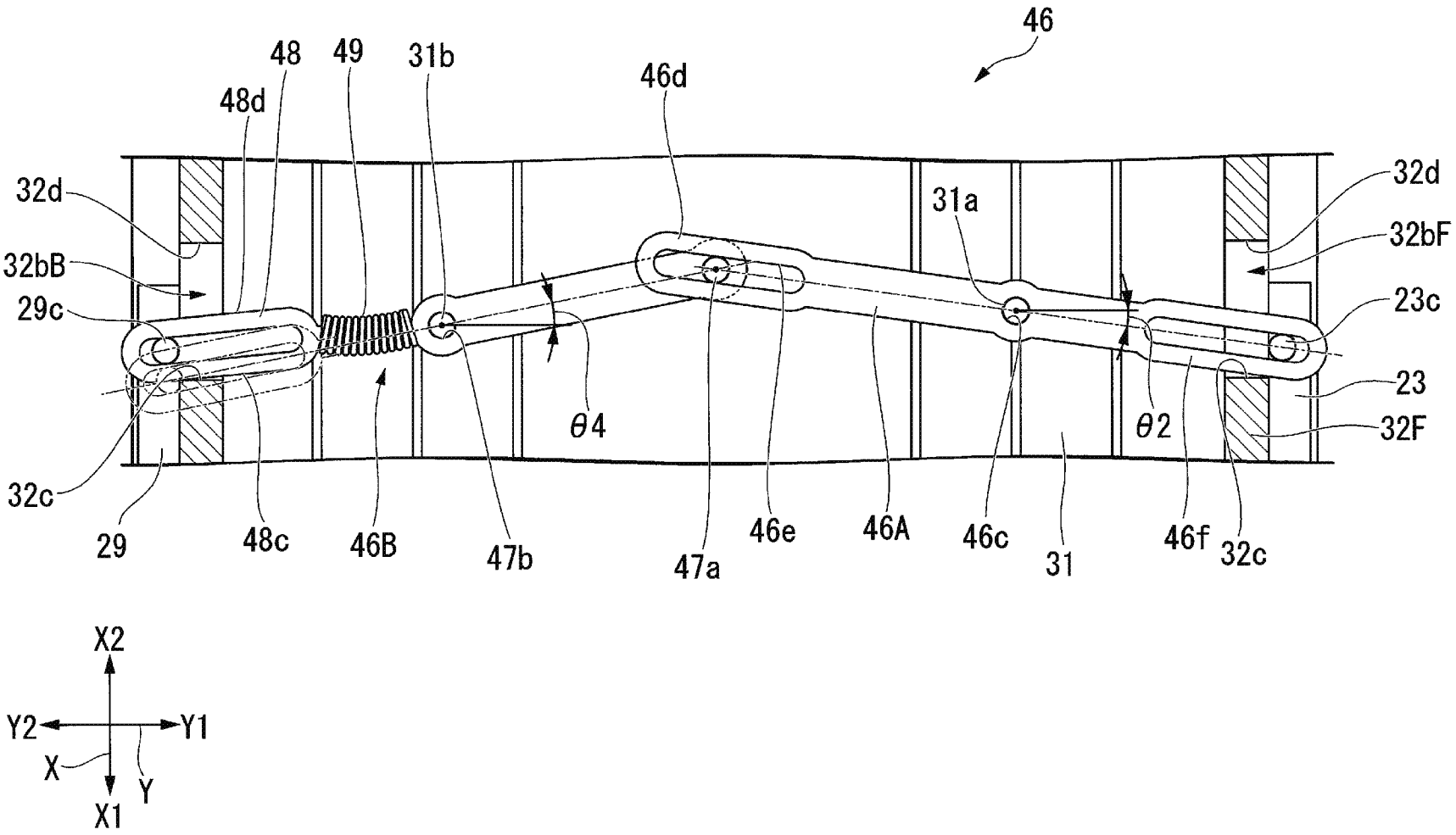
FIG. 11 is a schematic plan view illustrating a configuration example of the coupling member (second pivot state and fourth pivot state)

FIG. 8 is a schematic perspective view illustrating a configuration example of a coupling member in the manual sheet feeding device according to the embodiment. FIG. 9 is a schematic plan view illustrating the coupling member (first pivot state and third pivot state) in the manual sheet feeding device according to the embodiment. FIG. 10 is a schematic plan view illustrating a configuration example of an elastic member of the manual sheet feeding device according to the embodiment. FIG. 11 is a schematic plan view illustrating a configuration example of the coupling member (second pivot state and fourth pivot state) in the manual sheet feeding device according to the embodiment.

As illustrated in FIG. 8, the manual sheet feeding unit 18C further includes a link mechanism 46 (coupling member). The link mechanism 46 includes a first link 46A and a second link 46B.

The first link 46A has an elongated plate shape. The first link 46A is disposed on the bottom plate 31 (manual feed tray). One surface in the plate thickness direction of the first link 46A faces the bottom plate 31.

As illustrated in FIG. 9, a first engaging portion 46*a* (first joint portion) and a second engaging portion 46*d* (intermediate joint) are formed at both end portions in the longitudinal direction of the first link 46A. A first engagement hole 46*c* (first pivot joint) is formed between the first engaging portion 46*a* and the second engaging portion 46*d* in the longitudinal direction of the first link 46A.

The first engaging portion 46*a* includes a first engagement long hole 46*b* extending in the longitudinal direction of the first link 46A. The width in the lateral direction of the first engagement long hole 46*b* is equal to the outer diameter of the engagement shaft 23*c* of the lever 23.

The first engaging portion 46*a* is inserted into the link insertion long hole 32*b*F. The engagement shaft 23*c* is inserted into the first engagement long hole 46*b* of the first engaging portion 46*a* which extends outside the first side wall 32F in the first direction Y1. The engagement shaft 23*c* is slidable in the longitudinal direction of the first engagement long hole 46*b* on the inner peripheral surface of the first engagement long hole 46*b*.

The second engaging portion 46*d* includes a second engagement long hole 46*e* extending in the longitudinal direction of the first link 46A. The width in the lateral direction of the second engagement long hole 46*e* is equal to the outer diameter of the engagement shaft 47*a* described later. An engagement shaft 47*a* described later is inserted into the second engagement long hole 46*e*.

The first engagement hole 46*c* is a circular hole. The first engagement hole 46*c* penetrates in the plate thickness direction of the first link 46A. A first support shaft 31*a* (first pivot joint) is inserted into the first engagement hole 46*c*. The first support shaft 31*a* is provided on the top surface of the bottom plate 31. The first support shaft 31*a* is a cylindrical shaft extending along a normal line of the bottom plate 31. The outer diameter of the first support shaft 31*a* is equal to the inner diameter of the first engagement hole 46*c*. The first engagement hole 46*c* and the first support shaft 31*a* are fitted to each other so as to be pivotable about the central axis of the first support shaft 31*a*.

With such a configuration, the first link 46A is pivotable about the central axis of the first support shaft 31*a* within a plane parallel to the bottom plate 31. The pivot range of the first link 46A is restricted by the first end surface 32*c* and the second end surface 32*d* within the tray side long hole 32*a*F.

In FIG. 9, a first pivot state of the first link 46A is illustrated. The first pivot state is a state in which the first link 46A is maximally pivoted counterclockwise as illustrated in the drawing. In the first pivot state, the second side surface 46*g* on the second direction X2 side in the lateral direction of the first engaging portion 46*a* abuts on the second end surface 32*d* in the first side wall 32F.

In the first pivot state, the engagement shaft 23*c* engaged with the first engagement long hole 46*b* is most moved in the second direction X2 in the movement range of the engagement shaft 23*c* in the conveyance direction X.

In the first pivot state, a pivot angle of the first link 46A, which is measured counterclockwise as illustrated in the drawing from the axis extending in the conveyance orthogonal direction Y, is represented by θ1.

The second link 46B includes a lever portion 47, an engaging portion 48 (second joint portion), and an elastic deformation portion 49 (elastic member).

The lever portion 47 has an elongated plate shape. The lever portion 47 is disposed on the bottom plate 31. One surface in the plate thickness direction of the lever portion 47 faces the bottom plate 31.

At both end portions in the longitudinal direction of the lever portion 47, an engagement shaft 47*a* (intermediate joint) and a second engagement hole 47*b* (second pivot joint) are formed, respectively.

An end portion of the lever portion 47 in which the engagement shaft 47*a* is formed is sandwiched between the second engaging portion 46*d* and the bottom plate 31. The engagement shaft 47*a* has a cylindrical shape extending from the lever portion 47 toward the second engaging portion 46*d*. The outer diameter of the engagement shaft 47*a* is equal to the width in the lateral direction of the second engagement long hole 46*e*. The engagement shaft 47*a* is inserted into the second engagement long hole 46*e*. The engagement shaft 47*a* is slidable in the longitudinal direction of the second engagement long hole 46*e* on the inner peripheral surface of the second engagement long hole 46*e*.

The second engagement hole 47*b* is a circular hole. The second engagement hole 47*b* penetrates in the plate thickness direction of the lever portion 47. A second support shaft 31*b* is inserted into the second engagement hole 47*b*. The second support shaft 31*b* is provided on the top surface of the bottom plate 31. The second support shaft 31*b* is a cylindrical shaft extending along the normal line of the bottom plate 31. The outer diameter of the second support shaft 31*b* is equal to the inner diameter of the second engagement hole 47*b*. The second engagement hole 47*b* and the second support shaft 31*b* are fitted to each other so as to be pivotable about the central axis of the second support shaft 31*b*. The second support shaft 31*b* is disposed at a position facing the first support shaft 31*a* in the conveyance orthogonal direction Y.

As illustrated by a broken line in FIG. 10, a first fixing protrusion 47*c* protrudes from the tip of the end portion of the lever portion 47 where the second engagement hole 47*b* is formed. The first fixing protrusion 47*c* is pushed into the inside of the elastic deformation portion 49 described later. The first fixing protrusion 47*c* fixes the lever portion 47 to the elastic deformation portion 49 described later.

As illustrated in FIG. 9, the engaging portion 48 has an elongated plate shape. The engaging portion 48 is disposed on the bottom plate 31. One surface in the plate thickness direction of the engaging portion 48 faces the bottom plate 31.

As illustrated in FIG. 10, the engaging portion 48 includes a third engaging long hole 48*a* and a second fixing protrusion 48*b*.

As illustrated in FIG. 9, the third engaging long hole 48*a* extends in the longitudinal direction of the engaging portion 48. The width in the lateral direction of the third engagement long hole 48*a* is equal to the outer diameter of the engagement shaft 29*c* of the link 29.

The engaging portion 48 is inserted into the link insertion long hole 32*b*B. The engagement shaft 29*c* is inserted into a portion of the third engagement long hole 48*a* of the engaging portion 48 which extends outside the first side wall 32F in the second direction Y2. The engagement shaft 29*c* is slidable in the longitudinal direction of the third engagement long hole 48*a* on the inner peripheral surface of the third engagement long hole 48*a*.

As illustrated by the broken line in FIG. 10, the second fixing protrusion 48*b* protrudes from a longitudinal end portion of the engaging portion 48. The second fixing protrusion 48*b* is pushed into the inside of an elastic deformation portion 49 described later. The second fixing protrusion 48*b* fixes the engaging portion 48 to an elastic deformation portion 49 described later.

The elastic deformation portion 49 couples the lever portion 47 and the engaging portion 48. A natural state of the elastic deformation portion 49 at the time of coupling is a state in which the elastic deformation portion 49 is not elastically deformed by external force acting on the second link 46B. In the natural state, the elastic deformation portion 49 aligns the longitudinal center axes of the lever portion 47 and the engaging portion 48 on the same straight line.

The first fixing protrusion 47*c* of the lever portion 47 is press-fitted to a first end portion 49*a* in the longitudinal direction of the elastic deformation portion 49. A second fixing protrusion 48*b* of the engaging portion 48 is press-fitted to a second end portion 49*b* on a side opposite to the first end portion 49*a* in the longitudinal direction.

However, the coupling means between the lever portion 47 and the engaging portion 48 and the elastic deformation portion 49 is not limited to press fitting.

The bending rigidity of the elastic deformation portion 49 is lower than the bending rigidity of any of the lever portion 47 and the engaging portion 48 with respect to bending around the normal line of the pivot plane of the second link 46B. For example, when a moment of force acts on the engaging portion 48 around the second support shaft 31*b*, mainly the elastic deformation portion 49 is elastically bent and deformed in the direction of the force. An amount of deformation of the engaging portion 48 and the lever portion 47 is smaller than a magnitude of bending deformation of the elastic deformation portion 49. It is more preferable that the amount of deformation of the engaging portion 48 and the lever portion 47 is negligible as compared to the magnitude of bending deformation of the elastic deformation portion 49.

For example, as illustrated by the solid line in FIG. 9, when an external force is applied from the second end surface 32*d* to the engaging portion 48 by contact with the second end surface 32*d* of the link insertion long hole 32*b*B, the elastic deformation portion 49 is elastically bent counterclockwise as illustrated in the drawing around the second support shaft 31*b*.

The shape and material of the elastic deformation portion 49 are not particularly limited as long as the bending rigidity as described above can be obtained.

In the example illustrated in FIG. 9, the elastic deformation portion 49 is formed of a coil spring. As a spring constant of the coil spring, the spring constant for off-axis bending is greater than a spring constant for axial compression and tension. It is more preferable that the coil spring used for the elastic deformation portion 49 is tightly wound.

With such a configuration, the second link 46B is a link extending straight in a state where no external force that elastically deforms the elastic deformation portion 49 acts. However, the second link 46B is bendable at the elastic deformation portion 49 because bending deformation occurs at the elastic deformation portion 49 at the middle portion in the longitudinal direction depending on the direction of the external force and the magnitude of the external force.

The second link 46B is pivotably supported in a plane parallel to the bottom plate 31 by the second support shaft 31*b*. However, the pivot range of the lever portion 47 is restricted by the pivot range of the second engaging portion 46*d* engaged with the engagement shaft 47*a*. The pivot range of the engaging portion 48 is restricted by the first end surface 32*c* and the second end surface 32*d* within the tray side long hole 32*a*B.

In FIG. 9, a third pivot state of the second link 46B is illustrated. The third pivot state is a state where the lever portion 47 of the second link 46B is maximally pivoted clockwise as illustrated in the drawing by the first link 46A being in the first pivot state. In the third pivot state, in the movement range of the engagement shaft 47*a* in the conveyance direction X, the engagement shaft 47*a* is most moved in the first direction X1. The state of the engaging portion 48 at this time will be described later.

In the third pivot state, a pivot angle of the lever portion 47, which is measured clockwise as illustrated in the drawing from the axis extending in the conveyance orthogonal direction Y, is represented by θ3.

In FIG. 11, the second pivot state of the first link 46A and the fourth pivot state of the second link 46B are illustrated.

The second pivot state is a state in which the first link 46A is maximally pivoted clockwise as illustrated in the drawing. In the second pivot state, the first side surface 46*f* on the first direction X1 side in the lateral direction of a first engaging portion 46*a* abuts on the first end surface 32*c* of the first side wall 32F.

In the second pivot state, the engagement shaft 23*c* is most moved in the first direction X1 in the movement range of the engagement shaft 23*c* in the conveyance direction X.

In the second pivot state, a pivot angle of the first link 46A, which is measured clockwise as illustrated in the drawing from the axis extending in the conveyance orthogonal direction Y, is represented by θ2.

The magnitudes of the pivot angles θ1 and θ2 may be equal to or different from each other.

The fourth pivot state is a state where the lever portion 47 of the second link 46B is maximally pivoted counterclockwise as illustrated in the drawing by the first link 46A being in the second pivot state. In the fourth pivot state, the engagement shaft 47*a* is most moved in the second direction X2 in the movement range of the engagement shaft 47*a* in the conveyance direction X. A state of the engaging portion 48 at this time will be described later.

In the fourth pivot state, the pivot angle of the lever portion 47, which is measured counterclockwise as illustrated in the drawing from the axis extending in the conveyance orthogonal direction Y, is represented by θ4.

The magnitudes of the pivot angles θ3 and θ4 may be equal to or different from each other.

As described above, the first link 46A and the second link 46B constitute a coupling member by engagement of the second engagement long hole 46*e* and the engagement shaft 47*a*. The coupling member is provided between the engagement shafts 23*c* and 29*c*. The coupling member interlocks movement of the engagement shaft 23*c* and the engagement shaft 29*c* in the conveyance direction X. The moving directions of the engagement shafts 23*c* and 29*c* are always the same.

However, in this embodiment, the coupling member is configured such that the second side surface 48*d* of the engaging portion 48 of the second link 46B abuts on the second end surface 32*d* of the second side wall 32B immediately before the first link 46A pivots counterclockwise as illustrated in the drawing to be in the first pivot state. Furthermore, the coupling member is configured such that the first side surface 48*c* of the engaging portion 48 of the second link 46B abuts on the first end surface 32*c* of the second side wall 32B immediately before the first link 46A pivots clockwise as illustrated in the drawing to be in the second pivot state.

When it is assumed that the engagement shaft 23*c* is a base node and the engagement shaft 29*c* is a follower node, the coupling member of this embodiment is a displacement amplification type link mechanism in which a unit displacement amount of the base node is amplified and transmitted to the follower node when the first end surface 32*c* of the second side wall 32B does not exist. That is, in the coupling member, when the first end surface 32*c* of the second side wall 32B does not exist, since the displacement amount of the follower node is larger than the displacement amount of the base node corresponding to a first displacement amount of the first input member, the second input member can be given a second displacement amount larger than the first displacement amount through the follower node.

With this configuration, in the second link 46B, the elastic deformation portion 49 is bent in counterclockwise as illustrated in the drawing as the engaging portion 48 receives an external force in the first direction X1 from the second end surface 32*d* immediately before the third pivot state (see FIG. 9). Similarly, in the second link 46B, the elastic deformation portion 49 is bent counterclockwise as illustrated in the drawing as the engaging portion 48 receives an external force in the second direction X2 from the first end surface 32*c* immediately before the fourth pivot state (see FIG. 11).

In this embodiment, in the link mechanism 46 which is the coupling member, the first link 46A on the base node side is a displacement amplification type link mechanism, and the second link 46B on the follower node side is a displacement equal-magnification type link mechanism.

Each of the first link 46A and the second link 46B in this embodiment is a lever for transmitting displacement of an input end in a reverse direction at an output end. The magnitude of the displacement of the input end in the conveyance direction X at the first link 46A and the second link 46B is A, and the magnitude of the displacement of the output end in the conveyance direction X is B. B/A is variable magnification of the link.

However, in the first link 46A, a force point (a contact portion between the engagement shaft 23*c* and the first engagement long hole 46*b*) moves in the conveyance direction X, and an action point (a contact portion between the engagement shaft 47*a* and the second engagement long hole 46*e*) moves in a circular arc centered on the second support shaft 31*b*. For that reason, variable magnification of the first link 46A depends on the pivot angle.

In the second link 46B, a force point (a contact portion between the engagement shaft 47*a* and the second engagement long hole 46*e*) moves in a circular arc centered on the second support shaft 31*b* and an action point (a contact portion between the engagement shaft 29*c* and the third engagement long hole 48*a*) moves in the conveyance direction X. For that reason, variable magnification of the second link 46B depends on the pivot angle.

The variable magnification of the link may be satisfied in the first pivot state (third pivot state) and the second pivot state (fourth pivot state). However, the variable magnification of the second link 46B in the third pivot state and the fourth pivot state is calculated on the assumption that the link insertion long hole 32*b*B does not exist. Hereinafter, for simplicity, a case of θ1=θ2 and θ3=θ4 will be described.

Specifically, as illustrated in FIG. 9, in the first link 46A, the distance between the center O23*c* of the engagement shaft 23*c* and the center O31*a* (coupling position at the first pivot joint) of the first support shaft 31*a* in the first pivot state is d1. Here, the position of the center O23*c* corresponds to the coupling position in the first engaging portion 46*a* which is the first joint portion. The center O31*a* coincides with the center O46*c* of the first engagement hole 46*c*.

In the first link 46A, the distance between the center O31*a* and the center O47*a* of the engagement shaft 47*a* engaged with the second engaging portion 46*d* in the first pivot state is d2 (where, d2>d1). Here, the position of the center O47*a* corresponds to the coupling position at the intermediate joint formed of the second engaging portion 46*d* and the engagement shaft 47*a*.

Accordingly, the variable magnification of the first link 46A is larger than one. As a result, the first link 46A is a displacement amplification type link mechanism.

In contrast, in the second link 46B, the distance between the center O47*a* of the engagement shaft 47*a* and the center O31*b* (coupling position of the second pivot joint) of the second support shaft 31*b* is d3. Here, the center O31*b* coincides with the center O47*b* of the second engagement hole 47*b*.

In the second link 46B, when there is no positional restriction due to the link insertion long hole 32*b*B (see the two-dot chain line in the drawing), the distance between the center O31*b* and the center O29*c* of the engagement shaft 29*c* engaged with the third engagement long hole 48*a* in the third pivot state of the second link 46B is d4 (where, d4=d3). Here, the position of the center O29*c* when there is no positional restriction due to the link insertion long hole 32*b*B corresponds to the coupling position in the engaging portion 48 which is the second joint portion.

Accordingly, the variable magnification of the second link 46B is one. As a result, the second link 46B is a displacement equal-magnification type link mechanism.

As such, since the link mechanism 46 is formed of the displacement amplification type first link 46A and the displacement equal-magnification type second link 46B, the link mechanism 46 is a displacement amplification type link mechanism as a whole.

The link mechanism 46 satisfies the following expression (1).

$$\frac{d4}{d3} > \frac{d1}{d2} \tag{1}$$

If Expression (1) is modified, then (d2/d1)×(d4/d3)>1. Expression (1) represents a relation that at least one of (d2/d1) and (d4/d3) is larger than one. In order for the link mechanism 46 to be a displacement amplification type link mechanism as a whole, the variable magnification of the first link 46A and the second link 46B may satisfy Expression (1).

In the case of θ≠θ2 and θ3 ≠θ4, although dimensional values of d1 to d4 in the respective pivot states differ depending on the pivot angle, it is sufficient for the variable magnification to satisfy Expression (1).

Thus, the description of the manual sheet feeding unit 18C is ended, and the description will be returned to the other device parts of the image forming apparatus 1.

The transfer unit 17 illustrated in FIG. 1 forms an image on the sheet P based on image data. The transfer unit 17 is, for example, a tandem-type color printer.

The transfer unit 17 includes image forming units 51Y, 51M, 51C, and 51K for each color of yellow (Y), magenta (M), cyan (C), and black (K), an exposure device 52, and an intermediate transfer belt 53.

The exposure device 52 irradiates the image forming units 51Y, 51M, 51C, and 51K with exposure light $L_Y$, $L_M$, $L_C$, and $L_K$ made up of, for example, laser beams.

The configurations of the image forming units 51Y, 51M, 51C, and 51K are common to each other except that the color of toner is different. Hereinafter, an example of the image forming unit 51K will be described.

Figure 12:
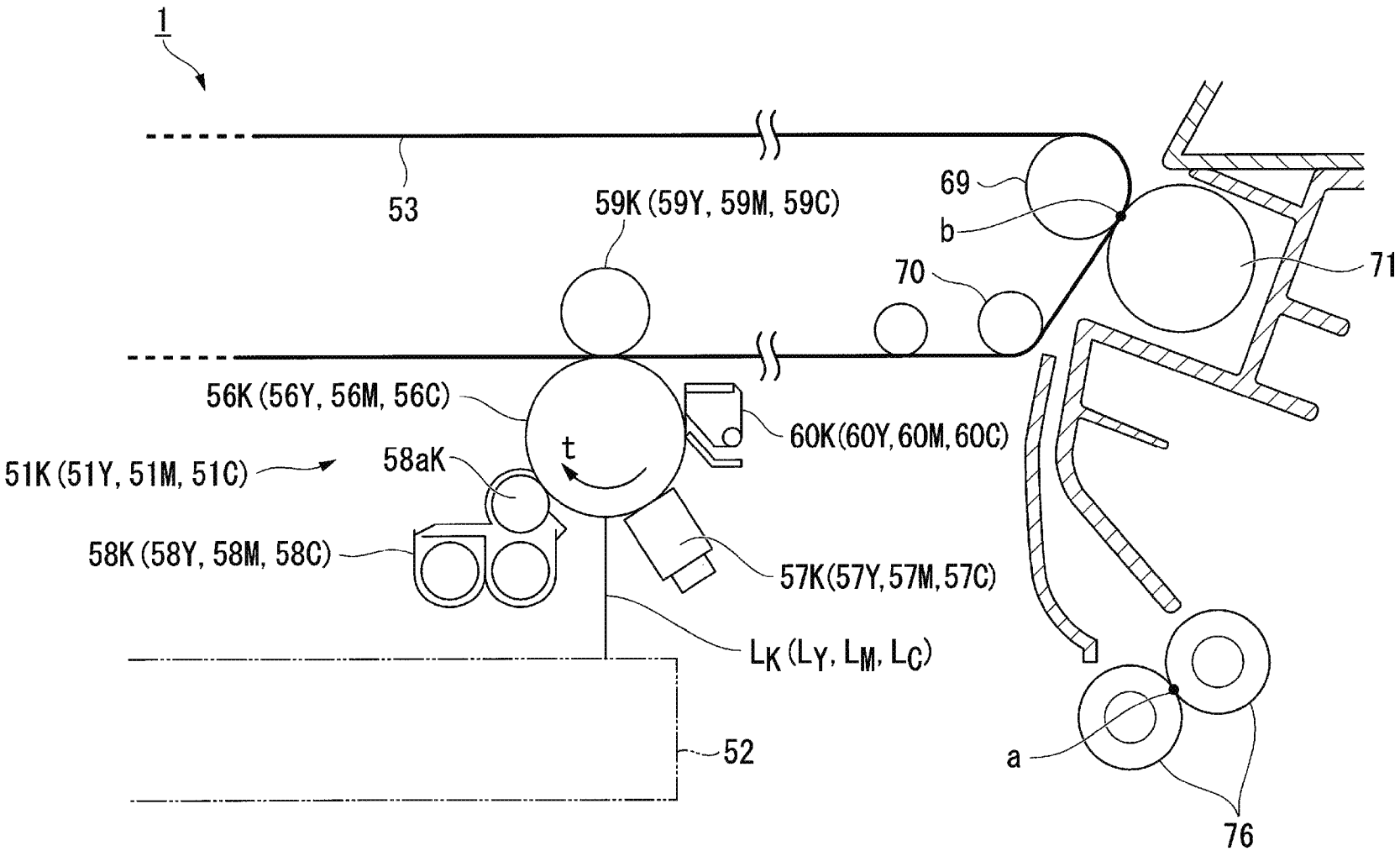
FIG. 12 is a schematic cross-sectional view illustrating a configuration example of an image forming unit in the image forming apparatus.

FIG. 12 is a schematic cross-sectional view illustrating a configuration example of an image forming unit in the image forming apparatus according to the embodiment.

As illustrated in FIG. 12, the image forming unit 51K includes a photoreceptor drum 56K that rotates in a rotational direction t. Around the photoreceptor drum 56K, a charger 57K, a developing device 58K, a primary transfer roller 59K, a cleaner 60K, and the like are disposed in this order in the rotational direction t.

The charger 57K of the image forming unit 51K uniformly charges the surface of the photoreceptor drum 56K.

The exposure unit 52 generates exposure light $L_K$ modulated based on image data. The exposure light $L_K$ exposes the surface of the photoreceptor drum 56K. The exposure unit 52 forms an electrostatic latent image on the photoreceptor drum 56K.

The developing device 58K supplies a black toner to the photoreceptor drum 56K by a developing roller 58*a*K to which a developing bias is applied. The developing device 58K develops the electrostatic latent image on the photoreceptor drum 56K.

The cleaner 60K removes the residual toner on the surface of the photoreceptor drum 56K.

The image forming units 51Y, 51M, and 51C include the photosensitive drums 56Y, 56M, and 56C, chargers 57Y, 57M, and 57C, primary transfer rollers 59Y, 59M, and 59C, cleaners 60Y, 60M, and 60C that are respectively similar to the photosensitive drum 56K, the charger 57K, the primary transfer roller 59K, and the cleaner 60K of the image forming unit 51K.

The image forming units 51Y, 51M, and 51C have developing devices 58Y, 58M, and 58C that differ only in toner color, corresponding to the developing device 58K of the image forming unit 51K.

As illustrated in FIG. 1, above the image forming units 51Y, 51M, 51C, and 51K, a supply unit 66 that supplies the toner to the developing devices 58Y, 58M, 58C, and 58K is disposed. The supply unit 66 includes toner cartridges 66Y, 66M, 66C, and 66K. The toner cartridges 66Y, 66M, 66C and 66K contain yellow, magenta, cyan, and black toners, respectively.

The intermediate transfer belt 53 is wound around a driving roller 69 and a plurality of driven rollers 70. The intermediate transfer belt 53 is driven by the drive roller 69 to move cyclically.

As illustrated in FIG. 12, the primary transfer roller 59K (59Y, 59M, and 59C) is disposed on the inside of the intermediate transfer belt 53 at a position facing the photoreceptor drum 56K (56Y, 56M, and 56C) with the intermediate transfer belt 53 interposed therebetween.

The primary transfer roller 59K (59Y, 59M, and 59C) primarily transfers the toner images on the photosensitive drum 56K (56Y, 56M, and 56C) to the intermediate transfer belt 53.

The secondary transfer roller 71 faces the driving roller 69 with the intermediate transfer belt 53 interposed therebetween. An abutting portion between the intermediate transfer belt 53 and the secondary transfer roller 71 forms a secondary transfer position b.

When the sheet P passes the secondary transfer position b, the secondary transfer roller 71 secondarily transfers the toner image on the intermediate transfer belt 53 to the sheet P.

As illustrated in FIG. 1, on the conveyance path from the sheet feeding cassette 18A to the secondary transfer roller 71, sheet feeding rollers 75A and registration rollers 76 are provided. The sheet feeding rollers 75A convey the sheet P taken out of the sheet feeding cassette 18A by the sheet feeding mechanism 19A.

The registration rollers 76 adjust a position of a tip end of the sheet P fed from the feed roller 75A at each other's abutting position. The registration rollers 76 convey the sheet P so that a tip end of a transfer area of the toner image on the sheet P reaches the secondary transfer position b when the tip end of the toner image reaches the secondary transfer position b.

Sheet feeding rollers 75B are provided on the conveyance path from the sheet feeding cassette 18B to the sheet feeding rollers 75A. The sheet feeding rollers 75B convey the sheet P taken out of the sheet feeding cassette 18B by the sheet feeding mechanism 19B toward the sheet feeding rollers 75A.

A conveyance path is formed by a conveyance guide 78 between the manual sheet feeding mechanism 19C and the registration rollers 76. The manual sheet feeding mechanism 19C conveys the sheet P taken out of the manual sheet feeding unit 18C toward the conveyance guide 78. The sheet P being moved along the conveyance guide 78 reaches the registration rollers 76.

A fixing unit 81 is disposed on the downstream side (upper side in the drawing) of the secondary transfer roller 71 in the conveyance direction of the sheet P. The fixing unit 81 fixes the toner image on the sheet P.

A conveyance roller 82 is disposed on the downstream side (upper left side in the drawing) of the fixing unit 81 in the conveyance direction of the sheet P. The conveyance rollers 82 discharge the sheet P to a paper discharge unit 83.

Next, a configuration of a control unit 91 of the image forming apparatus 1 will be described.

Figure 13:
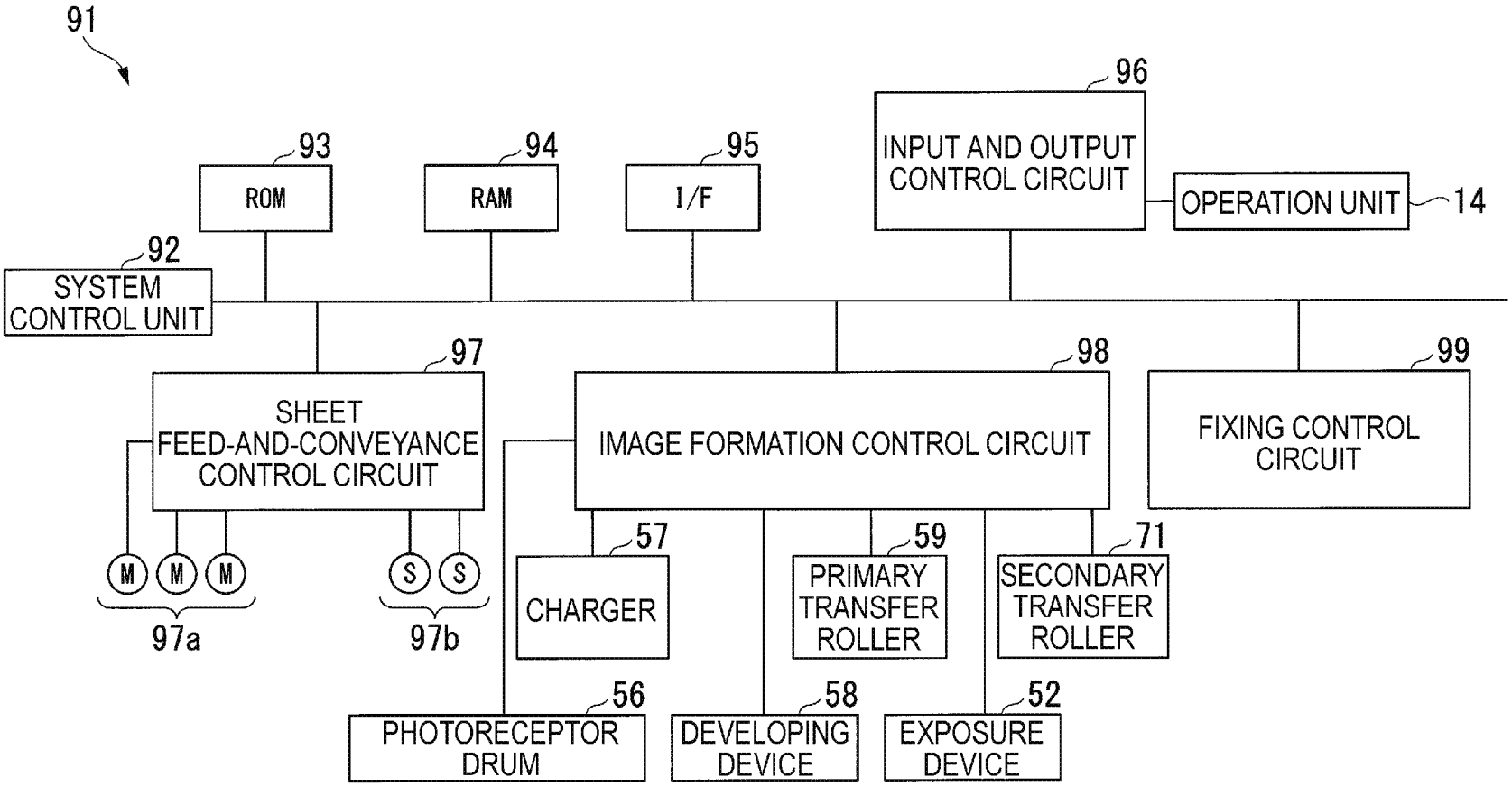
FIG. 13 is a block diagram illustrating a configuration example of a control unit.

FIG. 13 is a block diagram illustrating a configuration example of the control unit 91 of the image forming apparatus 1. However, in FIG. 13, for ease of viewing, members distinguished by subscripts Y, M, C, and K are collectively represented by symbols without these subscripts. In the description with reference to FIG. 13, symbols in which the subscripts Y, M, C, and K are omitted may be used.

The control unit 91 includes a system control unit 92, a read only memory (ROM) 93, a random access memory (RAM) 94, an interface (I/F) 95, an input and output control circuit 96, and a sheet feed-and-conveyance control circuit 97, an image formation control circuit 98, and a fixing control circuit 99.

The system control unit 92 controls the entire image forming apparatus 1. The system control unit 92 realizes a processing function for image formation by executing a program stored in the ROM 93 or the RAM 94 described later. As a device configuration of the system control unit 92, for example, a processor such as a central processing unit (CPU) may be used.

The ROM 93 stores a control program that controls a basic operation of image forming processing, control data, and the like.

The RAM 94 is a working memory in the control unit 91. For example, the control program or control data of the ROM 93 is loaded into the RAM 94 as needed.

The I/F 95 performs communication with a connection device connected to the main body 11. For example, the scanner unit 15 is communicably connected to the I/F 95.

The input and output control circuit 96 controls the operation unit 14. The input and output control circuit 96 sends an operation input received from the operation unit 14 to the system control unit 92.

The sheet feed-and-conveyance control circuit 97 controls a drive system included in the main body 11. For example, the drive system includes sheet feeding mechanisms 19A and 19B, sheet feeding rollers 75A and 75B, the manual sheet feeding mechanism 19C, and drive motors 97*a* for driving the registration rollers 76.

A plurality of sensors 97*b* such as a sheet detection sensor is electrically connected to the sheet feed-and-conveyance control circuit 97.

The image forming control circuit 98 controls the photoreceptor drum 56, the charger 57, the exposure device 52, the developing device 58, the primary transfer roller 59, and the secondary transfer roller 71 based on the control signal from the system control unit 92.

The fixing control circuit 99 controls the drive motor and the halogen lamp of the fixing unit 81 based on the control signal from the system control unit 92.

Next, the operation of the image forming apparatus 1 according to this embodiment will be described focusing on the operation of the manual sheet feeding unit 18C.

Figure 14:
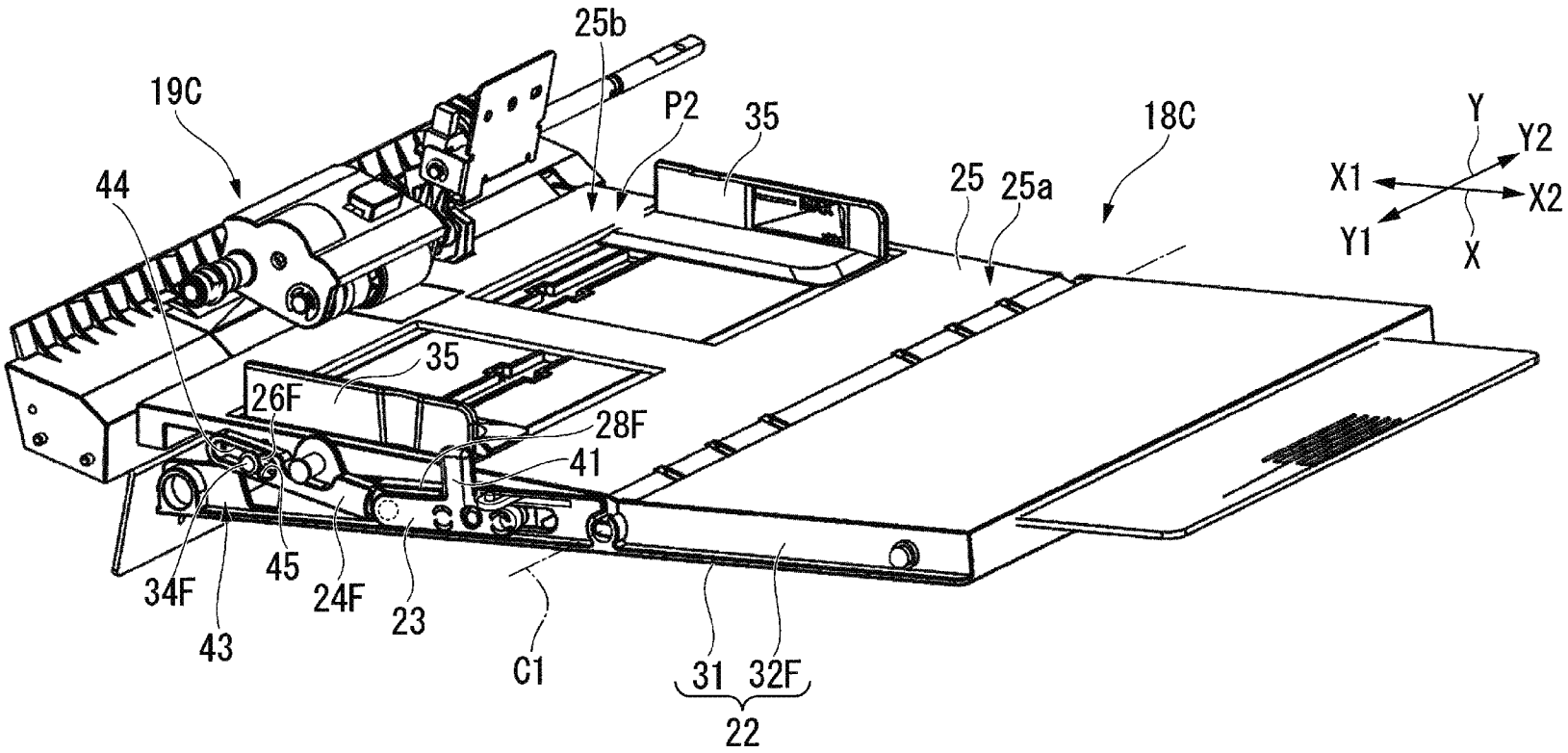
FIG. 14 is a view for explaining an operation in perspective view of the manual sheet feeding device according to the embodiment.
Figure 15:
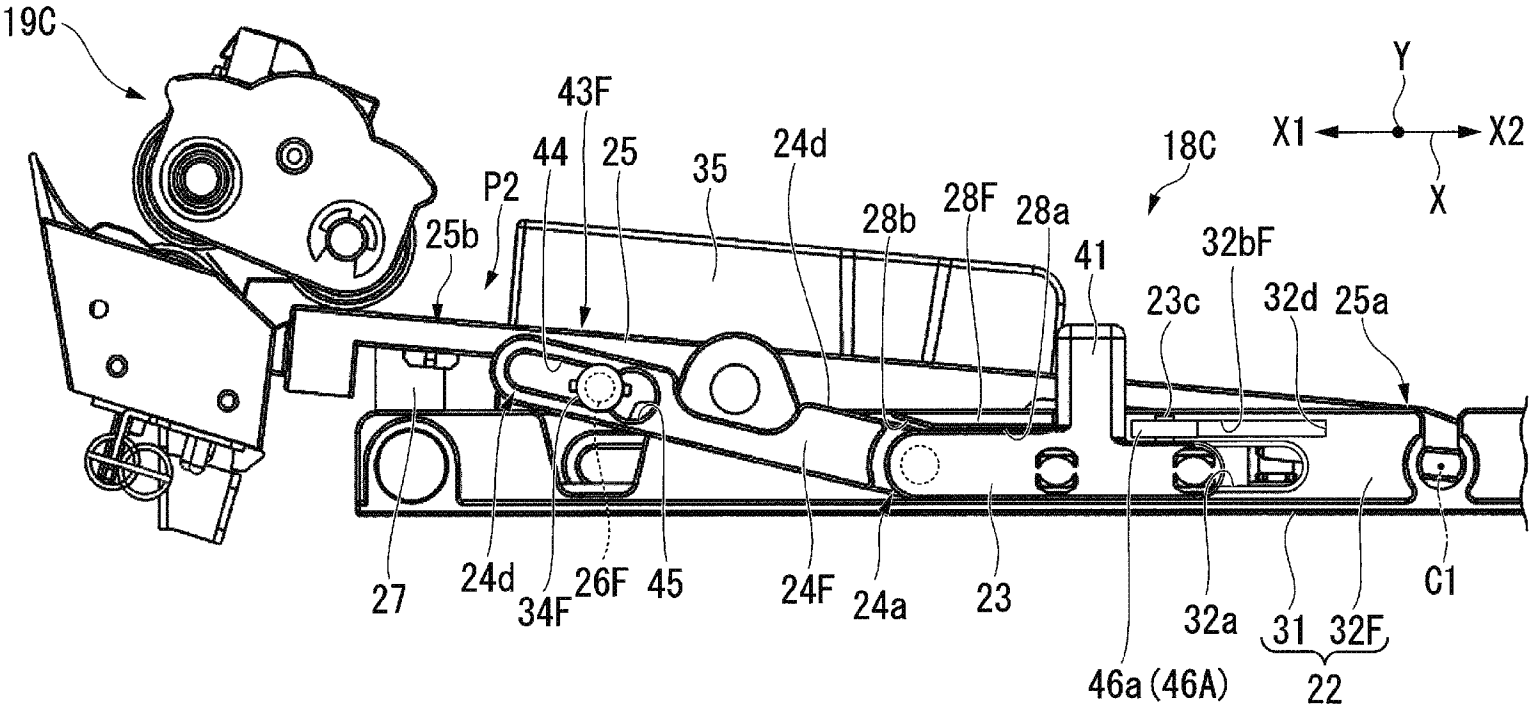
FIG. 15 is a view for explaining an operation in front view of the manual sheet feeding device.

FIG. 14 is a view for explaining an operation in perspective view of the manual sheet feeding device according to the embodiment. FIG. 15 is a view for explaining an operation in front view of the manual paper feed device according to the embodiment.

For example, the image forming apparatus 1 prints an image on the sheet P fed from the manual sheet feeding unit 18C.

A user can set the sheet P in the manual sheet feeding unit 18C as follows.

In the manual sheet feeding unit 18C, the user moves the lever 23 in the conveyance direction X such that the position of the pressure tray 25 is switched between the pressure release position P1 described above and illustrated in FIG. 3 and a pressure position P2 illustrated in FIG. 14.

At the pressure release position P1, the second end portion 25*b* of the pressure tray 25 is substantially parallel to the bottom plate 31 of the tray receiver 22.

The pressure position P2 is a position where the sheet P on the pressure tray 25 can be pressurized toward the manual sheet feeding mechanism 19C by pivoting the pressure tray 25 around the axis C1 above the pressure release position P1. The pivot angle of the pressure position P2 with respect to the pressure release position P1 differs depending on the thickness of the sheet P on the pressure tray 25. At the pressure position P2, the second end portion 25*b* of the pressure tray 25 is pushed up by the spring 27 toward the manual sheet feeding mechanism 19C.

In order to set the sheet P in the manual sheet feeding unit 18C, it is necessary to set the position of the pressure tray 25 to the pressure release position P1.

In order to move the pressure tray 25 from the pressure position P2 to the pressure release position P1, the user operates the knob 41 or the like of the manual sheet feeding unit 18C to move the lever 23 to a movement limit in the second direction X2. As illustrated in FIG. 4, the movement limit of the lever 23 in the second direction X2 is a position at which the end surface in the second direction X2 on the inner peripheral surface of the tray side long hole 32*a*F abuts on the protrusion 39 of the lever 23.

As illustrated in FIGS. 14 and 15, at the pressure position P2, the lever 23 is positioned at the movement limit in the first direction X1 in the conveyance direction X.

With this configuration, in the link 24F, a flat surface portion on the upper side of the first end portion 24*a* is positioned at the first position closer to the first direction X1 than the holding surface 28*a*. In the first position, since the link 24F is not restricted by the holding surface 28*a*, the link 24F can be pivoted upward.

From this state, when the user moves the lever 23 in the second direction X2, the link 24F moves together with the lever 23 in the second direction X2. When the link 24F starts contacting the guide surface 28*b* of the fixed portion 28F, the link 24F receives an external force downward from the guide surface 28*b*. The link 24F pivots about the central axis of the shaft member 38 at the first end portion 24*a*. In the link 24F, when the upper flat portion on the upper side of the first end portion 24*a* enters below the holding surface 28*a*, the flat portion moves along the holding surface 28*a* in the second direction X2. With this configuration, the longitudinal direction of the link 24F coincides with the conveyance direction X. When the lever 23 moves to the movement limit in the second direction X2, the link 24F is accordingly positioned at the second position closest to the second direction X2 in the movement range.

On the other hand, at the pressure position P2, the link 29 is positioned at a position in the conveyance direction X according to displacement transmitted from the link mechanism 46 to the engagement shaft 29*c* in the conveyance direction X. In this embodiment, the link 29 is positioned at the movement limit in the first direction X1 in the conveyance direction X, similarly to the lever 23, by the action of the link mechanism 46 described later.

With this configuration, in the link 24B, the flat surface portion on the upper side of the first end portion 24*a* is positioned at the third position closer to the first direction X1 than the holding surface 28*a* of the fixing portion 28B. In the third position, since the link 24B is not restricted by the holding surface 28*a*, the link 24B can be pivoted upward.

From this state, when the user moves the lever 23 in the second direction X2, the link 29 moves in the second direction X2 by the external force acting on the engagement shaft 29*c* through the link mechanism 46. In this case, the link 24B also moves in the second direction X2 together with the link 29. The link 24B pivots about the central axis of the shaft member 38 at the first end portion 24*a* similarly to the link 24F. Furthermore, the flat portion on the upper side of the first end portion 24*a* of the link 24F enters below the holding surface 28*a*, and moves in the second direction X2 with the longitudinal direction coincided with the conveyance direction X. The link 24B is positioned at the fourth position closest to the second direction X2 in the movement range of the link 24B.

With the movement of the link 24F from the first position to the second position as described above, the tray side protrusion 26F within the link side long hole 44 moves downward so as to approach the bottom plate 31.

Similarly, with the movement of the link 24B from the third position to the fourth position as described above, the tray side protrusion 26B within the link side long hole 44 moves downward so as to approach the bottom plate 31.

As a result, the second end portion 25*b* of the pressure tray 25 to which the tray side protrusions 26F and 26B are fixed is also moved downward. The pressure tray 25 pivots about the axis C1 to compress the spring 27. When the lever 23 reaches the movement limit in the second direction X2, the pressure tray 25 is positioned at the pressure release position P1.

The operation of moving the pressure tray 25 from the pressure position P2 to the pressure release position P1 is described as above. The operation of moving the pressure tray 25 from the pressure release position P1 to the pressure position P2 is the reverse of the operation described above, and thus the description thereof is omitted.

The lever 23, the link 24F, and the fixing portion 28F constitute a first link mechanism. The first link mechanism transmits displacement (first displacement) of the engagement shaft 23*c* to the tray side protrusion 26F. However, the amount of displacement transmitted by the first link mechanism is processed at appropriate variable magnification from the first displacement according to the configuration of the first link mechanism.

The link 29, the link 24B, and the fixing portion 28B that are disposed on the second side wall 32B constitute a second link mechanism. The second link mechanism transmits displacement (second displacement) of the engagement shaft 29*c* to the tray side protrusion 26B. However, the amount of displacement transmitted by the second link mechanism is processed at appropriate variable magnification from the second displacement according to the configuration of the second link mechanism.

As described above, in this embodiment, the configuration of the second link mechanism is plane-symmetrical to a plane orthogonal to the conveyance orthogonal direction Y except that a part of the shape of the link 29 is different from that of the lever 23.

For that reason, when the second displacement coincides with the first displacement, the displacement amounts of the tray side protrusions 26B and 26F coincide with each other. In this case, the pressure tray 25 is moved uniformly to the pressure release position P1 in the conveyance orthogonal direction Y.

However, if the second displacement does not coincide with the first displacement, the displacement amounts (lowering amounts) of the tray side protrusions 26B and 26F do not coincide with each other, and thus the pressure tray 25 descends in a twisted state. In this case, when the sheet P is set on the pressure tray 25, an abutting state between the roller and the sheet P in the manual sheet feeding mechanism 19C is different between the first direction Y1 side and the second direction Y2 side. When sheet feeding is repeated in this state, for example, the roller in the manual sheet feeding mechanism 19C is partially worn, and sheet feeding performance deteriorates.

In this embodiment, in order to make the second displacement coincide with the first displacement, the engagement shafts 23*c* and 29*c* are connected by the link mechanism 46. Here, an action of the link mechanism 46 will be described.

In a state where the pressure tray 25 is disposed at the pressure position P2, as illustrated in FIG. 11, the lever 23 is disposed at a position most moved in the first direction X1 in the movement range of the lever 23.

In this case, the first link 46A is in the second pivot state by being interlocked with the engagement shaft 23*c*. In the second pivot state, the first displacement of the engagement shaft 23*c* is transmitted to the engagement shaft 47*a* in a state of being amplified according to the variable magnification of the first link 46A.

When the first link 46A is in the second pivot state, the lever portion 47 in which the engagement shaft 47*a* is engaged with the second engagement long hole 46*e* is in the fourth pivot state. Since the variable magnification of the second link 46B is 1, if the displacement in the first direction X1 is not restricted by the link insertion long hole 32*b*B, the first side surface 48*c* of the engaging portion 48 moves in the first direction X1 beyond the first end surface 32*c* (see two-dot chain line in the drawing).

However, the displacement of the first side surface 48*c* is restricted by the first end surface 32*c*. The first side surface 48*c* cannot move in the first direction X1 beyond the first end surface 32*c*. In this case, the elastic deformation portion 49 is bent clockwise as illustrated in the drawing by the external force acting on the engaging portion 48 from the first end surface 32*c*. For that reason, even if the movement of the engaging portion 48 is blocked by the first end surface 32*c*, the pivot angle of the fourth pivot state of the lever portion 47 does not change.

Thus, in the pressure position P2, the positions of the engagement shafts 23*c* and 29*c* in the conveyance direction X are identical to each other.

From this state, when the lever 23 is moved in the second direction X2, rotational moment in the counterclockwise direction as illustrated in the drawing about the first support shaft 31*a* acts on the first link 46A through the engagement shaft 23*c*.

As illustrated in FIG. 9, when the lever 23 is moved most in the first direction X1 in the movement range, the first link 46A is in the first pivot state. In the first pivot state, the first displacement of the engagement shaft 23*c* is transmitted to the engagement shaft 47*a* in a state of being amplified according to the variable magnification of the first link 46A.

When the first link 46A is in the first pivot state, the lever portion 47 in which the engagement shaft 47*a* is engaged with the second engagement long hole 46*e* is in the third pivot state. Since the variable magnification of the second link 46B is 1, if the displacement in the second direction X2 is not restricted by the link insertion long hole 32*b*B, the second side surface 48*d* of the engaging portion 48 moves in the second direction X2 beyond the second end surface 32*d* (see two-dot chain line in the drawing).

However, the displacement of the second side surface 48*d* is restricted by the second end surface 32*d*. The second side surface 48*d* cannot move in the second direction X2 beyond the second end surface 32*d*. In this case, the elastic deformation portion 49 is bent counterclockwise as illustrated in the drawing by the external force acting on the engaging portion 48 from the second end surface 32*d*. For that reason, even if the movement of the engaging portion 48 is blocked by the second end surface 32*d*, the pivot angle of the lever portion 47 in the third pivot state does not change.

Thus, at the pressure release position P1, the positions of the engagement shafts 23*c* and 29*c* in the conveyance direction X are identical to each other.

In the link mechanism 46, it is also conceivable that transmission efficiency of displacement falls below a design value due to deformation or the like between the members engaged with each other. However, in this embodiment, by setting the displacement amplification factor of the link mechanism 46 so as to be able to absorb an transmission error of the displacement, the second side surface 48*d* of the engaging portion 48 can be brought into contact with the second end surface 32*d* even if there is the transmission error of the displacement. As a result, the second displacement and the first displacement can be reliably made the same.

Accordingly, deterioration of sheet feeding performance in the manual sheet feeding mechanism 19C as described above is prevented.

The relationship between the second displacement and the first displacement at the pressure position P2 is also the same.

After the pressure tray 25 is moved to the pressure release position P1, the user adjusts the distance between the pair of horizontal registration plates 35 as needed, and disposes the plurality of sheets P to be aligned with the direction of the transport direction X on the pressure tray 25.

Thereafter, the user operates the knob 41 or the like to move the lever 23 in the first direction X1. With this configuration, the pressure tray 25 pivots about the axis C1 and rises. In this case, since the first displacement and the second displacement are equal to each other, the amount of rise of the second end portion 25*b* of the pressure tray 25 is uniform in the conveyance orthogonal direction Y. The pressure tray 25 is biased by the spring 27. The spring 27 presses the upper end portion of the sheet P on the pressure tray 25 against the roller of the manual sheet feeding mechanism 19C. In this case, since twisting in the conveyance orthogonal direction Y does not occur in the pressure tray 25, the pressure tray 25 is uniformly pressed against the rollers in the conveyance orthogonal direction Y.

Thus, the setting of the sheet P in the manual sheet feeding unit 18C is completed. In the image forming apparatus 1, the sheet P of the manual sheet feeding unit 18C can be fed.

With this configuration, image formation on the sheet P set in the manual sheet feeding unit 18C becomes possible.

The user presses a start button of the operation unit 14. The control unit 91 detects the press and starts control for reading and printing of an original document by the system control unit 92.

The system control unit 92 sends control signals for controlling the operation of the fixing unit 81, the manual feeding mechanism 19C, the drive system of main body 11, the photoreceptor drum 56, the charger 57, the exposure device 52, the developing device 58, the primary transfer roller 59, and the secondary transfer roller 71 to the fixing control circuit 99, the sheet feed-and-conveyance control circuit 97, and image formation control circuit 98, respectively.

The image forming control circuit 98 starts an image forming process of the image forming units 51Y, 51M, 51C, and 51K in this order.

In parallel with this, when the tip end of the toner image reaches the secondary transfer position b, the sheet feed-and-conveyance control circuit 97 drives the registration rollers 76 so that the tip end of the transfer area of the toner image on the sheet P reaches the secondary transfer position b.

The image formation control circuit 98 applies a secondary transfer voltage to the secondary transfer roller 71 in order to perform secondary transfer of the toner image on the sheet P passing the secondary transfer position b. The sheet P passed the secondary transfer position b is conveyed toward the fixing unit 81 along the conveyance path. When the sheet P enters the fixing unit 81, the toner image is fixed to the sheet P by the fixing unit 81. The sheet P on which the toner image is already transferred is discharged to the sheet discharge unit 83.

Thus, image formation on one sheet P is completed.

As described above, the manual sheet feeding unit 18C in this embodiment can switch the pressure tray 25 between the pressure release position P1 and the pressure position P2 by the first input member and the first displacement member provided on the first side wall 32F, the first input member and the first displacement member provided on the second side wall 32B, the coupling member (link mechanism 46) for giving the second displacement amount larger than the first displacement amount by which the first input member is displaced to the second input member.

In this case, since the link mechanism 46 is constituted by the first link 46A and the second link 46B, even if a transmission error of displacement occurs to some extent in the link mechanism 46, the first displacement of the engagement shaft 23*c* of the lever 23 can be reliably transmitted to the engagement shaft 29*c*.

For that reason, sheet feeding performance of the manual sheet feeding mechanism 19C can be stabilized.

The link mechanism 46 has high tolerance of transmission error of displacement. For that reason, as the link mechanism 46, a simple and compact configuration in which a transfer error of displacement is likely to occur can be used. For example, the first link 46A and the second link 46B can be made of thin resin.

In the link mechanism 46, the first link 46A and the second link 46B pivot within a plane parallel to the bottom plate 31. For that reason, according to the link mechanism 46, the members do not have to be moved out of the plane parallel to the bottom plate 31, and thus the thickness of the manual sheet feeding unit 18C can be reduced.

MODIFIED EXAMPLE

Next, a modified example of the elastic deformation portion in the manual sheet feeding unit 18C of this embodiment will be described.

Figure 16:
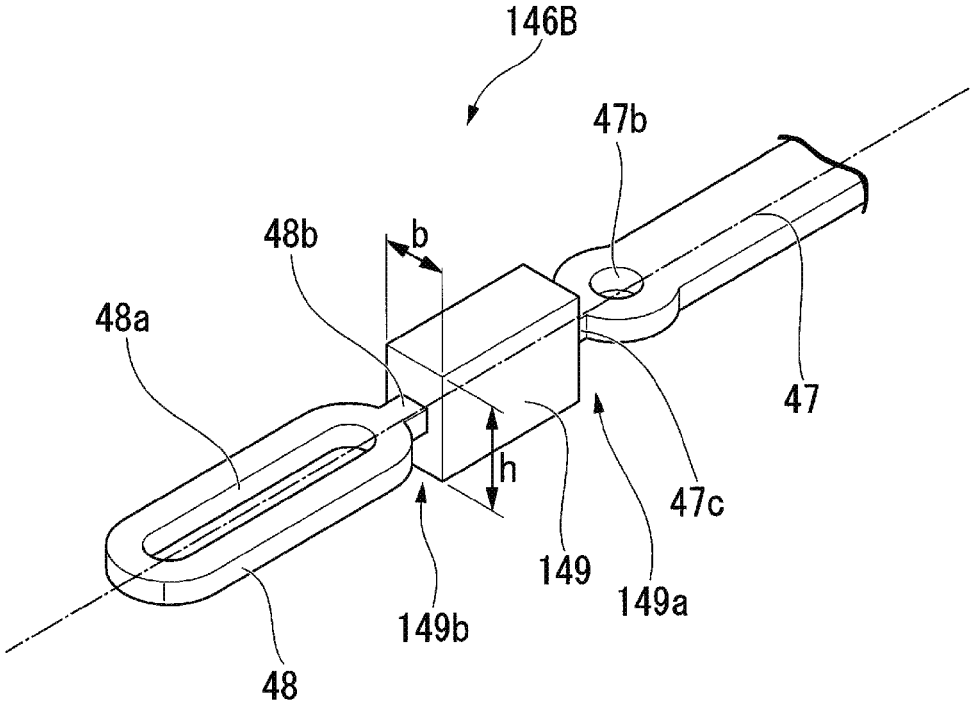
FIG. 16 is a schematic perspective view illustrating a modified example of the elastic member.

FIG. 16 is a schematic perspective view illustrating a modified example of the elastic member in the manual sheet feeding device according to the embodiment.

In FIG. 16, a main part of a second link 146B that can be used instead of the second link 46B of the manual sheet feeding unit 18C is illustrated.

The second link 146B includes an elastic deformation portion 149 (elastic member) instead of the elastic deformation portion 49 of the second link 46B in the embodiment described above. Hereinafter, differences from the embodiment described above will be mainly described.

The elastic deformation portion 149 couples the lever portion 47 and the engaging portion 48 in the second link 146B, similarly as in the elastic deformation portion 49 described above. In FIG. 16, an example of the elastic deformation portion 149 in a natural state at the time of coupling is illustrated. The elastic deformation portion 149 aligns the central axes of the lever portion 47 and the engaging portion 48 in the longitudinal direction on the same straight line. The elastic deformation portion 149 has a columnar shape and extends in one direction. In the elastic deformation portion 149, the length in the extending direction is equal to the length of the elastic deformation portion 49 in the natural state.

The first fixing protrusion 47*c* of the lever portion 47 is embedded in a first end portion 149*a* in the longitudinal direction of the elastic deformation portion 149. The first end portion 149*a* of the elastic deformation portion 149 is coupled to the lever portion 47 through the first fixing protrusion 47*c*.

The second fixing protrusion 48*b* of the engaging portion 48 is embedded in a second end portion 149*b* on a side opposite to the first end portion 149*a* in the longitudinal direction of the elastic deformation portion 149. The second end portion 149*b* of the elastic deformation portion 149 is coupled to the engaging portion 48 through the second fixing protrusion 48*b*.

The positional relationship between the second engagement hole 47*b* and the third engagement long hole 48*a* in the longitudinal direction of the second link 146B is similar to that of the second link 46B described above. The second link 146B is a lever similar to the second link 46B. The second link 146B including the elastic deformation portion 149 of this modified example is used as a link mechanism having variable magnification of one.

Similar to the elastic deformation portion 49, the bending rigidity of the elastic deformation portion 149 is lower than the bending rigidity of any of the lever portion 47 and the engaging portion 48 regarding bending around the normal line (central axis of the second engagement hole 47*b*) of the pivot plane of the second link 146B.

Furthermore, in the elastic deformation portion 149, bending rigidities in two directions orthogonal to the longitudinal direction of the elastic deformation portion 149 are different from each other. In the elastic deformation portion 149, the bending rigidity within the pivot plane of the second link 146B is lower than the bending rigidity in the direction orthogonal to the longitudinal direction of the elastic deformation portion 149 and the normal line of the pivot plane.

The means for giving anisotropy described above to the bending rigidity of the elastic deformation portion 149 is not particularly limited.

For example, as illustrated in FIG. 16, the elastic deformation portion 149 may be configured by a quadrangular prism-like or plate-like elastic member having a rectangular cross section. In this case, the rectangular cross-section of the elastic deformation portion 149 has a short side of a length b and a long side h of the length h (where, h>b). The short side is disposed parallel to the pivot plane of the second link 146B. The long side is disposed perpendicular to the pivot plane.

Such elastic deformation portion 149 may be manufactured, for example, by a simple substance of an elastic material selected from metal, resin, and elastomer, or a composite of two or more elastic materials selected from metal, resin, and elastomer.

For example, when the elastic deformation portion 149 is made up of a composite of a plurality of elastic materials having different rigidities, anisotropy of the bending rigidity can be easily adjusted by appropriately setting the shape or disposition of each elastic material. In this case, for example, a combination of a high elasticity material having a long rectangular cross section in a direction perpendicular to the pivot plane and a low elasticity material sandwiching the high elasticity material in a lateral direction or surrounding the high elasticity material as a core material may be used. In this case, it is also possible for the whole of the elastic deformation portion 149 to have a square cross section or a rectangular cross section which is thin in a direction perpendicular to the pivot plane.

The second link 146B including the elastic deformation portion 149 of this modified example can be suitably used for the link mechanism 46, similarly to the second link 46B of the embodiment described above.

Similarly as in the embodiment described above, the second link 146B can absorb the transmission error of displacement from the first link 46A, and thus the second displacement of the engagement shaft 29*c* at the pressure release position P1 can be reliably made to coincide with the first displacement of the engagement shaft 23*c*. As a result, it is possible to prevent sheet feeding performance of the manual sheet feeding mechanism 19C from being deteriorated.

Furthermore, according to this modified example, since the elastic deformation portion 149 has anisotropy of bending rigidity, out-of-plane bending deformation in the direction intersecting the pivot plane is suppressed as compared to in-plane bending deformation in the pivot plane. For that reason, a pivot posture of the engaging portion 48 is stabilized. For example, when the engaging portion 48 is displaced in the direction intersecting the pivot plane during pivoting, there is also a concern that friction with the inner peripheral surface in the lateral direction of the link insertion long hole 32*b*B is increased and the movement of the engagement shaft 29*c* is not smoothly performed.

According to this modified example, since the engaging portion 48 does not shake in the direction intersecting the pivot plane during pivoting, sliding resistance is stabilized even if the engaging portion 48 slides on the link insertion long hole 32*b*B. As a result, the movement of the engaging portion 48 and the engagement shaft 29*c* is smoothly performed.

In the embodiment described above, the coupling member is described as an example in which the coupling member includes two links. However, the coupling member is not limited to the configuration including the link mechanism, as long as the coupling member can be configured as a mechanism for giving a second displacement amount larger than the first displacement amount, by which the first input member is displaced, to the second input member.

Even when the coupling member is configured by a link mechanism, the number of links is not limited to two. For example, the coupling member may have three or more links as long as the coupling member can be configured as a displacement amplification type link mechanism as a whole.

Furthermore, when the coupling member is configured by the link mechanism, the displacement amplification type link mechanism may be configured, as a whole, by at least one link mechanism being a displacement amplification type link mechanism.

However, the displacement amplification type link mechanism is more preferably provided near the first input member because the loss of displacement transmission from the first input member can be reduced. It is particularly preferable that the displacement amplification type link mechanism is coupled to the first input member. However, the disposition of the displacement amplification type link mechanism is not limited to these.

In the embodiment described above, the description is made on an example in which the first joint portion and the second joint portion are respectively constituted by end portions having long holes of the first link and the second link and form an engagement structure together with the respective engagement shafts of the first input member and the second input member. However, the configuration of the first joint portion and the second joint portion is not limited to this. For example, an engagement structure may be used in which a first link (second link) is provided with a longitudinally movable projection and the projection engages with a hole portion provided in the first input member (second input member).

In the embodiment described above, the example of the case where the image forming apparatus is a composite machine is described. However, the image forming apparatus is not limited to the composite machine. For example, an image forming apparatus may be a printer, a facsimile, a copying machine, or the like.

Furthermore, image forming means of the image forming apparatus is not limited to electrophotographic type image forming means. For example, the image forming apparatus may be an inkjet apparatus.

In each embodiment described above, the example of the case where of the manual sheet feeding device is provided in a part of the image forming apparatus is described. However, the manual sheet feeding device may be provided, for example, in a part of a document conveyance device or the like.

According to at least one embodiment described above, it is possible to provide a manual sheet feeding device and an image forming apparatus capable of preventing deterioration in sheet feeding performance.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A manual sheet feeding device comprising:

a manual feed tray onto which a sheet can be placed;

a sheet feeder configured to feed the sheet placed on the manual feed tray in a conveyance direction;

a pressure plate configured to force the sheet toward the sheet feeder when in a pressure position;

a first displacement member that is provided on a first side portion of the manual feed tray and extends in a conveyance orthogonal direction that is oriented orthogonal to the conveyance direction in a plane parallel to a placement surface of the manual feed tray, wherein the first displacement member is configured to displace the pressure plate from the pressure position to a pressure release position in response to being displaced from a first position to a second position;

a first input member that is disposed on the first side portion and configured to displace the first displacement member between the first position and the second position in response to being displaced by a first predetermined amount;

a second displacement member that is provided on a second side portion of the manual feed tray opposite the first side portion in the conveyance orthogonal direction, wherein the second displacement member is configured to displace the pressure plate from the pressure position to the pressure release position in response to being displaced from a third position to a fourth position;

a second input member that is disposed on the second side portion and configured to displace the second displacement member between the third position and the fourth position in response to being displaced by a second predetermined amount;

a coupling member configured to displace the second input member by a second displacement amount in response to the first input member being displaced by a first displacement amount, wherein the second displacement amount is larger than the first displacement amount;

a restricting member that restricts a displacement amount of the second input member; and an elastic member that is provided on the coupling member and configured to elastically deform when the displacement amount of the second input member is restricted by the restricting member.

2. The manual sheet feeding device of claim 1, wherein the coupling member includes:

a first link that includes a first joint portion interlockably coupled to the first input member, that is coupled to the manual feed tray through a first pivot joint at an intermediate portion in the longitudinal direction, and that is pivotable within a pivot plane parallel to the placement surface about the first pivot joint;

a second link that includes a second joint portion interlockably coupled to the second input member, that is coupled to the manual feed tray through a second pivot joint at the intermediate portion in the longitudinal direction, that is pivotable within the pivot plane about the second pivot joint, and that includes the elastic member; and an intermediate joint that interlockably couples an end portion of the first link positioned opposite the first joint portion to an end portion of the second link positioned opposite the second joint portion, wherein the elastic member is provided between the second pivot joint and the second joint portion in the second link.

3. The manual sheet feeding device of claim 2, wherein a length d1 is defined from a coupling position at the first joint portion to the first pivot joint, wherein a length d2 is defined from the first pivot joint to a coupling position at the intermediate joint, wherein a length d3 is defined from the coupling position at the intermediate joint to the second pivot joint, wherein a length d4 is defined from the second pivot joint to a coupling position at the second joint portion, and wherein a ratio of d4 to d3 is greater than a ratio of d1 to d2.

4. The manual sheet feeding device of claim 1, wherein the elastic member has a bending rigidity of bending outside the pivot plane that is greater than a bending rigidity of bending within the pivot plane.

5. The manual sheet feeding device of claim 1, wherein the restricting member is formed on the second side portion.

6. An image forming apparatus comprising:

the manual sheet feeding device of claim 1.

7. The manual sheet feeding device of claim 1, wherein the sheet feeder includes at least one roller.

8. A sheet feeding device, comprising:

a tray receiver configured to support a sheet;

a pressure tray coupled to the tray receiver and repositionable relative to the tray receiver between a pressure position and a pressure release position;

a sheet feeder configured to feed the sheet across the tray receiver and the pressure tray in a conveyance direction when the pressure tray is in the pressure position;

a first input member slidably coupled to the tray receiver and repositionable along the conveyance direction between a first position and a second position;

a first displacement member coupled to the first input member and the pressure tray;

a second input member slidably coupled to the tray receiver and repositionable along the conveyance direction between a third position and a fourth position; and a second displacement member coupled to the second input member and the pressure tray, wherein the first displacement member is configured to displace the pressure tray from the pressure position to the pressure release position in response to the first input member moving from the first position to the second position; and wherein the second displacement member is configured to displace the pressure tray from the pressure position to the pressure release position in response to the second input member moving from the third position to the fourth position.

9. The sheet feeding device of claim 8, wherein the first displacement member is pivotably coupled to the first input member about an axis extending perpendicular to the conveyance direction, and wherein the first displacement member is slidably coupled to the pressure tray.

10. The sheet feeding device of claim 9, wherein the tray receiver includes a fixing portion defining a guide surface configured to engage the first displacement member to limit rotation of the first displacement member about the axis when the first input member is in the second position.

11. The sheet feeding device of claim 10, further comprising a spring coupled to the tray receiver and configured to bias the pressure tray toward the pressure position, wherein the pressure tray is pivotably coupled to the tray receiver.

12. The sheet feeding device of claim 8, further comprising a linkage configured to couple the first input member and the second input member such that a first displacement amount of the first input member causes a second displacement amount of the second input member.

13. The sheet feeding device of claim 12, wherein the second displacement amount is larger than the first displacement amount.

14. A sheet feeding device, comprising:

a tray receiver configured to support a sheet;

a sheet feeder configured to feed the sheet in a conveyance direction;

a pressure tray coupled to the tray receiver and repositionable relative to the tray receiver between a pressure position and a pressure release position, wherein the pressure tray is closer to the sheet feeder in the pressure position than in the pressure release position;

a first input member coupled to the tray receiver and configured to move the pressure tray from the pressure position to the pressure release position in response to moving along the conveyance direction from a first position to a second position;

a second input member coupled to the tray receiver and configured to move the pressure tray from the pressure position to the pressure release position in response to moving along the conveyance direction from a third position to a fourth position; and a linkage coupled to the first input member and the second input member, wherein the linkage is configured to bias the second input member toward the third position when the first input member is in the first position, and wherein the linkage is configured to bias the second input member toward the fourth position when the first input member is in the second position.

15. The sheet feeding device of claim 14, wherein the linkage is configured to displace the second input member by a second displacement amount in response to the first input member being displaced by a first displacement amount, and wherein the second displacement amount is larger than the first displacement amount.

16. The sheet feeding device of claim 15, wherein the linkage includes:

a first link pivotably coupled to the tray receiver, the first link including a first joint portion coupled to the first input member;

a second link pivotably coupled to the tray receiver, the second link including a second joint portion coupled to the second input member; and an intermediate joint coupling the first link and the second link.

17. The sheet feeding device of claim 16, wherein the second link includes an elastic member provided between the second joint portion and the intermediate joint.

18. The sheet feeding device of claim 17, wherein the second link is configured to pivot within a pivot plane, and wherein the elastic member has a bending rigidity of bending outside the pivot plane that is greater than a bending rigidity of bending within the pivot plane.

19. The sheet feeding device of claim 14, wherein the linkage includes:

a link pivotably coupled to the tray receiver and coupled to the first input member;

a lever portion pivotably coupled to the tray receiver and coupled to the link;

an engaging portion coupled to the second input member; and an elastic member extending between and coupled to the lever portion and the engaging portion.

20. The sheet feeding device of claim 19, wherein the first input link and the second input link are positioned on opposite sides of the pressure tray.

* * * * *